US011251534B2

(12) United States Patent
Zhang et al.

(10) Patent No.: US 11,251,534 B2
(45) Date of Patent: Feb. 15, 2022

(54) ANTENNA AND TERMINAL

(71) Applicant: Huawei Technologies Co., Ltd., Shenzhen (CN)

(72) Inventors: Junhong Zhang, Dongguan (CN); Zhenghao Li, Shenzhen (CN); Shuhui Sun, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 26 days.

(21) Appl. No.: 16/956,188

(22) PCT Filed: Aug. 23, 2018

(86) PCT No.: PCT/CN2018/101975
§ 371 (c)(1),
(2) Date: Jun. 19, 2020

(87) PCT Pub. No.: WO2019/119843
PCT Pub. Date: Jun. 27, 2019

(65) Prior Publication Data

US 2020/0343643 A1 Oct. 29, 2020

(30) Foreign Application Priority Data

Dec. 21, 2017 (CN) ..... 201711398107.6
Feb. 11, 2018 (CN) ..... 201810142705.5

(51) Int. Cl.
*H01Q 11/14* (2006.01)
*H01Q 1/38* (2006.01)
(Continued)

(52) U.S. Cl.
CPC ..... *H01Q 11/14* (2013.01); *H01Q 1/38* (2013.01); *H01Q 9/065* (2013.01); *H01Q 13/16* (2013.01)

(58) Field of Classification Search
CPC . H01Q 11/14; H01Q 1/38; H01Q 5/10; H01Q 13/16; H01Q 9/065
See application file for complete search history.

(56) References Cited

U.S. PATENT DOCUMENTS 2,380,333 A 7/1945 Scheldorf
4,044,321 A * 8/1977 Vasile ..... H03H 9/02866 333/194

(Continued)

FOREIGN PATENT DOCUMENTS

CN 101399395 A 4/2009
CN 101536254 A 9/2009

(Continued)

*Primary Examiner* — Graham P Smith
*Assistant Examiner* — Jae K Kim
(74) *Attorney, Agent, or Firm* — Slater Matsil, LLP

(57) ABSTRACT

An antenna radiates signals in Band41 whose center frequency is $\lambda_1$ and Band42 whose center frequency is $\lambda_2$. A medium substrate is used as a carrier of a top radiating element, a phase inversion unit, and a bottom radiating element; an end of the top radiating element is connected to an end of the phase inversion unit; the other end of the phase inversion unit is connected to an end of the bottom radiating element, a length of the phase inversion unit is $3\lambda_2/2$, and the length of the phase inversion unit is greater than $\lambda_1/2$; and the phase inversion unit includes at least two current phase inversion points, a part between the at least two current phase inversion points does not produce radiation, and the top radiating element and the bottom radiating element horizontally radiate the signal in the Band41 and the signal in the Band42 omnidirectionally.

20 Claims, 46 Drawing Sheets

(51) Int. Cl.
*H01Q 13/16* (2006.01)
*H01Q 9/06* (2006.01)

(56) References Cited

U.S. PATENT DOCUMENTS 4,169,993 A * 10/1979 Taylor ..... H03J 7/20 380/34
5,379,456 A * 1/1995 Papadopoulos ..... H03D 1/22 329/358
5,568,161 A 10/1996 Fulmer, Sr.
5,787,126 A * 7/1998 Itoh ..... H03D 7/165 329/306
5,999,561 A * 12/1999 Naden ..... H04B 1/707 375/142
6,933,907 B2 8/2005 Shirosaka et al.
8,422,540 B1 * 4/2013 Negus ..... H01Q 21/062 375/219
8,471,775 B2 6/2013 Nakabayashi et al.
8,552,918 B2 10/2013 Lee et al.
2005/0094714 A1 * 5/2005 Robinson ..... H04B 1/0483 375/148
2009/0152353 A1 * 6/2009 Tsirline ..... G06K 7/0008 235/439
2009/0160576 A1 * 6/2009 Dent ..... H01Q 3/40 333/139
2011/0221648 A1 9/2011 Lee et al.
2012/0086604 A1 4/2012 Yang
2014/0187178 A1 7/2014 Yang et al.
2017/0054546 A1 * 2/2017 Kim ..... H04L 5/1469
2017/0141757 A1 * 5/2017 Schmidhammer ..... H03H 9/542
2017/0155375 A1 * 6/2017 Schmidhammer ..... H01P 5/16
2017/0264019 A1 9/2017 Mu
2018/0123710 A1 * 5/2018 Kim ..... H04L 5/0053

FOREIGN PATENT DOCUMENTS

CN 201319403 Y 9/2009
CN 202121060 U 1/2012
CN 202550069 U 11/2012
CN 203456585 U 2/2014
CN 203721885 U 7/2014
CN 104078770 A 10/2014
CN 104157963 A 11/2014
CN 104604025 A 5/2015
CN 204348909 U 5/2015
CN 105811094 A 7/2016
CN 105846064 A 8/2016
EP 2355245 A1 8/2011
JP H01100514 U 7/1989
JP H06283920 A 10/1994
JP 2003249810 A 9/2003
JP 2008154194 A 7/2008
JP 2016509393 A 3/2016
WO 2009045210 A1 4/2009
WO 2010108075 A2 9/2010
WO 2016180733 A1 11/2016

* cited by examiner

W=0.5 mm

W=2.7 mm

W=3.8 mm

W=0.5 mm

W=2.7 mm

W=3.8 mm

ANTENNA AND TERMINAL

CROSS-REFERENCE TO RELATED APPLICATIONS

This application is a national stage of International Application No. PCT/CN2018/101975, filed on Aug. 23, 2018, which claims priority to Chinese Patent Application No. 201810142705.5, filed on Feb. 11, 2018 and Chinese Patent Application No. 201711398107.6, filed on Dec. 21, 2017. All of the aforementioned applications are hereby incorporated by reference in their entireties.

TECHNICAL FIELD

This application relates to the communications field, and in particular, to an antenna and a terminal.

BACKGROUND

With development of communications technologies, various types of antennas such as a Franklin antenna are applied to various network devices, and the antennas are used for transmitting and receiving a wireless signal. A radiator of a Franklin antenna is formed by connecting a phase inversion unit and a vertical radiating element. Because the phase inversion unit portion is folded, internal currents offset each other, and the phase inversion unit does not produce radiation. In this case, only the radiating element produces radiation.

In actual communication application, a network device usually needs to radiate or receive signals in at least two frequency bands. A ratio of center frequencies of the signals in the at least two frequency bands usually approximates to 1.5. In an existing solution, a Franklin antenna can horizontally radiate a signal in only one frequency band. One Franklin antenna cannot completely cover the at least two frequency bands, but can radiate a signal in only one of the at least two frequency bands. Operating frequency bands Band41 (2496 MHz to 2690 MHz) and Band42 (3400 MHz to 3600 MHz) in a long term evolution (Long Term Evolution, LTE) system are used as an example. A Franklin antenna supporting horizontally high-gain omnidirectional radiation in the frequency band Band41 cannot horizontally radiate a signal in the frequency band Band42. If the network device needs to radiate signals in at least two frequency bands, when using one Franklin antenna, the network device cannot radiate the signals in the at least two frequency bands. In this case, the network device needs to include at least two antennas corresponding to the at least two frequency bands, increasing a footprint of the at least two antennas in the network device, and also increasing costs of using the antennas for data transmission by the network device. Therefore, how one Franklin antenna is used to horizontally radiate and receive the signals in the at least two frequency bands omnidirectionally becomes an issue to be urgently resolved.

SUMMARY

Embodiments of this application provide an antenna and a terminal, so as to use one antenna to radiate signals in at least two frequency bands, thereby reducing a size and costs of a network device.

In view of this, this application provides an antenna. The antenna radiates a signal in a Band41 and a signal in a Band42, a wavelength corresponding to a center frequency of the signal in the Band41 is $\lambda_1$, a wavelength corresponding to a center frequency of the signal in the Band42 is $\lambda_2$, and the antenna includes a medium substrate, a top radiating element, a phase inversion unit, and a bottom radiating element;

the medium substrate is used as a carrier of the top radiating element, the phase inversion unit, and the bottom radiating element;

an end of the top radiating element is connected to an end of the phase inversion unit;

the other end of the phase inversion unit is connected to an end of the bottom radiating element, a length of the phase inversion unit is $3\lambda_2/2$, and the length of the phase inversion unit is greater than $\lambda_1/2$; and the phase inversion unit includes at least two current phase inversion points, a part between the at least two current phase inversion points does not produce radiation, and the top radiating element and the bottom radiating element horizontally radiate the signal in the Band41 and the signal in the Band42 omnidirectionally.

This application further provides an antenna. The antenna radiates a first signal and a second signal, the first signal and the second signal are in different frequency bands, the first signal is corresponding to a first half-wavelength, the second signal is corresponding to a second half-wavelength, and the antenna includes a medium substrate, a top radiating element, a phase inversion unit, and a bottom radiating element. The medium substrate is used as a carrier of the top radiating element, the phase inversion unit, and the bottom radiating element. An end of the top radiating element is connected to an end of the phase inversion unit, the other end of the phase inversion unit is connected to an end of the bottom radiating element, a length of the phase inversion unit is a first odd multiple of the second half-wavelength, and the length of the phase inversion unit is greater than a second odd multiple of the first half-wavelength. The phase inversion unit includes at least two current phase inversion points, a part between the at least two current phase inversion points does not produce radiation, and the top radiating element and the bottom radiating element horizontally radiate the first signal and the second signal omnidirectionally.

In this embodiment of this application, a length of the antenna is changed, so that the length of the phase inversion unit of the antenna is the first odd multiple of the second half-wavelength, and the length of the phase inversion unit is greater than the second odd multiple of the first half-wavelength; and when the antenna is operating, the part between the phase inversion points in the phase inversion unit portion does not produce radiation, and the top radiating element and the bottom radiating element radiate the first signal and the second signal. Therefore, for the antenna provided in this application, one vertical antenna can radiate signals in at least two frequency bands.

In an implementation, that the top radiating element and the bottom radiating element horizontally radiate the first signal and the second signal omnidirectionally includes:

currents between at least two current phase inversion points included in a part whose length is the second odd multiple of the first half-wavelength and that is of the phase inversion unit offset each other, so that the part whose length is the second odd multiple of the first half-wavelength and that is of the phase inversion unit does not produce radiation, and the phase inversion unit portion except the part whose length is the odd multiple of the first half-wavelength, the top radiating element, and the bottom radiating element horizontally radiate the first signal omnidirectionally; and currents between at least two current phase inversion points included in a part whose length is the first odd multiple of the second half-wavelength and that is of the phase inversion unit offset each other, so that the phase inversion unit does not produce radiation, and the top radiating element and the bottom radiating element horizontally radiate the second signal omnidirectionally.

In this implementation of this application, when the antenna radiates the first signal, the part whose length is the second odd multiple of the first half-wavelength and that is of the phase inversion unit does not produce radiation because currents are in opposite directions and offset each other, and the phase inversion unit portion except the part whose length is the odd multiple of the first half-wavelength, the bottom radiating element, and the top radiating element radiate the first signal; when the antenna radiates the first signal, the phase inversion unit does not produce radiation because currents are in opposite directions and offset each other, and the bottom radiating element and the top radiating element radiate the second signal. Therefore, the antenna can radiate the first signal and the second signal. This implementation of this application is a specific implementation of radiating the first signal and the second signal by the antenna.

In an implementation, the phase inversion unit includes a fold line part and a vertical part, the vertical part includes a first slot and a second slot, the first slot is parallel to the second slot, and the first slot and the second slot divide a length area, in the phase inversion unit, corresponding to the first slot and the second slot into a first microstrip, a second microstrip, and a third microstrip. The first microstrip and the third microstrip are respectively located on two sides of the second microstrip. When the antenna radiates the second signal, currents at the first microstrip and the second microstrip are in opposite directions, and currents at the second microstrip and the third microstrip are in opposite directions, so that the second microstrip does not produce radiation.

In this implementation of this application, to further make the signals radiated by the antenna closer to a horizontal direction, the two slots are added to the vertical part of the phase inversion unit. In this case, currents at the microstrips on two sides of the slots are in opposite directions to a current at the microstrip between the slots, so that the currents at the microstrips on the two sides of the slots offset the current at the microstrip between the slots. This can reduce radiation produced by the phase inversion unit when the antenna radiates the second signal, thereby implementing antenna side lobe suppression when the antenna radiates the second signal.

In an implementation, a ratio between frequencies of the second signal and the first signal ranges from 1.3 to 1.6.

In this implementation of this application, the ratio between the frequencies of the second signal and the first signal ranges from 1.3 to 1.6. Therefore, the antenna can radiate signals in at least two frequency bands in this application.

In an implementation, the first signal is in a frequency band of 2496 MHz to 2690 MHz, and the second signal is in a frequency band of 3400 MHz to 3800 MHz.

In an implementation, a length of the antenna is 99 mm, and the antenna is three times the length of the first half-wavelength and five times the length of the second half-wavelength.

In this implementation of this application, the antenna is three times the length of the first half-wavelength and five times the length of the second half-wavelength. Therefore, depending on an actual status, the length of the phase inversion unit of the antenna may be a length of the first half-wavelength, and the phase inversion unit of the antenna may be three times the length of the second half-wavelength. This can make the antenna implement high-gain radiation of the first signal and the second signal.

In an implementation, a minimum width of the first microstrip is 2 mm, and a minimum width of the third microstrip is 2 mm.

In this implementation of this application, the minimum widths of the first microstrip and the third microstrip are 2 mm. In this case, a current generated by the second microstrip can be offset, so that the vertical part of the phase inversion unit does not produce radiation when the antenna radiates the second signal, making the second signal radiated by the antenna closer to horizontal omnidirection.

In an implementation, a width of the first slot ranges from 0.5 mm to 3.8 mm, and a width of the second slot ranges from 0.5 mm to 3.8 mm.

In an implementation, a length of the first slot is 8 mm, and a length of the second slot is 8 mm.

In an implementation, the bottom radiating element includes an upper radiating module and a lower radiating module, the upper radiating module is connected to the lower radiating module through a coaxial line, the lower radiating module includes a gap portion, the coaxial line is located in the gap portion of the lower radiating module, and the coaxial line is configured to feed the antenna.

In this implementation of this application, the upper radiating module is connected to the lower radiating module through the coaxial line, the lower radiating module includes the gap portion, and the coaxial line may pass through the gap portion of the lower radiating module. This can reduce impact of the coaxial line on antenna radiation.

This application further provides CPE. The CPE includes:

an antenna, a processor, a memory, a bus, and an input/output interface; the memory stores code; the antenna may be the antenna according to any one of the first aspect or the implementations of the first aspect; the memory stores the program code; and the processor sends a control signal to the antenna when invoking the program code in the memory, where the control signal is used to control the antenna to send a first signal or a second signal.

This application further provides a terminal. The terminal includes:

an antenna, a processor, a memory, a bus, and an input/output interface; the memory stores code; the antenna may be the antenna according to any one of the first aspect or the implementations of the first aspect; the memory stores the program code; and the processor sends a control signal to the antenna when invoking the program code in the memory, where the control signal is used to control the antenna to send a first signal or a second signal.

It can be learnt from the foregoing technical solutions that the embodiments of this application have the following advantage:

The antenna in the embodiments of this application may include the medium substrate, the top radiating element, the phase inversion unit, and the bottom radiating element. The length of the phase inversion unit is the first odd multiple of the second half-wavelength, and the length of the phase inversion unit is greater than the second odd multiple of the first half-wavelength. The first half-wavelength is half of a wavelength corresponding to the first signal, and the second half-wavelength is half of a wavelength corresponding to the second signal. In this case, when the antenna is in an operating state, the phase inversion unit may include the at least two current phase inversion points, the part between the at least two current phase inversion points does not produce radiation, the top radiating element and the bottom radiating element horizontally radiate the first signal and the second signal omnidirectionally, and the first signal and the second signal are in different frequency bands. Therefore, the antenna provided in the embodiments of this application can radiate signals in at least two different frequency bands.

DETAILED DESCRIPTION OF ILLUSTRATIVE EMBODIMENTS

The following describes technical solutions in the embodiments of this application with reference to the accompanying drawings in the embodiments of this application. The described embodiments are merely some but not all of the embodiments of this application. All other embodiments obtained by persons skilled in the art based on the embodiments of this application without creative efforts shall fall within the protection scope of this application.

Figure 1:
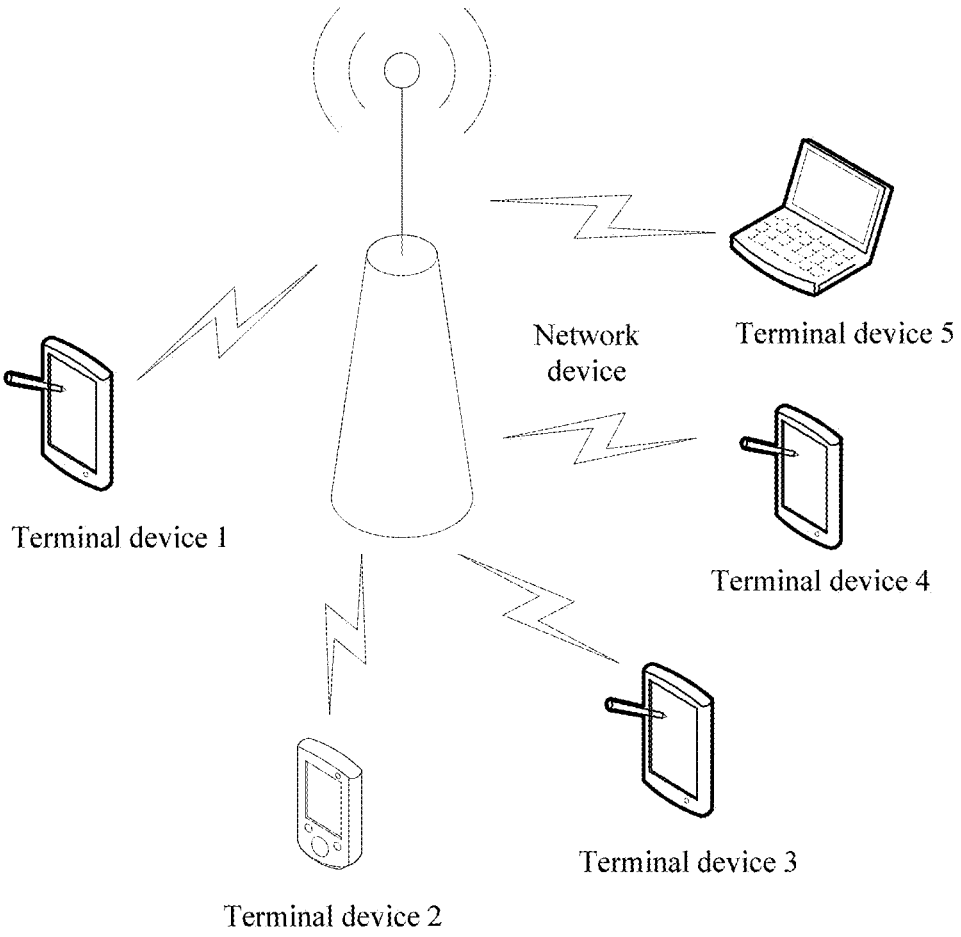
FIG. 1 is a schematic diagram of a system architecture according to an embodiment of this application.

FIG. 1 shows a system architecture of an antenna according to an embodiment of this application. A network device may send or receive a wireless signal by using an antenna, and a terminal device 1, a terminal device 2, a terminal device 3, and a terminal device 4 may be connected to the network device by using the wireless signal. The network device may be customer premises equipment (customer premises equipment, CPE), a router, a mobile station (mobile station, MS), a subscriber station (subscriber station, SS), or the like. The CPE may be a network device that converts a mobile cellular signal, such as a signal in LTE, wideband code division multiple access (wideband code division multiple access, W-CDMA), or global system for mobile communications (global system for mobile communication, GSM), into a wireless fidelity (wireless fidelity, Wi-Fi) signal or a wireless local area network (wireless local area networks, WLAN) signal. The CPE product usually needs to perform long-range communication, and therefore an antenna used for the CPE product usually needs to implement horizontally high-gain omnidirectional radiation. With development of technologies in the communications field, operating frequency bands of an increasing quantity of CPE products need to include both a Band41 (2496 MHz to 2690 MHz) and a Band42 (3400 MHz to 3600 MHz) in the LTE system, and even include more frequency bands. For example, the CPE needs to support the Band41, the Band42, and a Band43 (3600 MHz to 3800 MHz). In addition, operating frequency bands of an increasing quantity of routers also need to include both the Band41 and the Band42, or include the Band41, the Band42, the Band43, and the like. In this case, operating frequency bands of the antenna provided in this embodiment of this application include at least two frequency bands, so that the network device can use one antenna to radiate or receive signals in the at least two frequency bands, thereby reducing costs of using the antenna for signal transmission or receiving by the network device. Moreover, because one antenna radiates or receives signals in the at least two frequency bands, compared with two antennas used for respectively transmitting and receiving signals in two frequency bands, one antenna is apparently smaller than two antennas in size, so that the network device using such an antenna has a smaller size.

Figure 2:
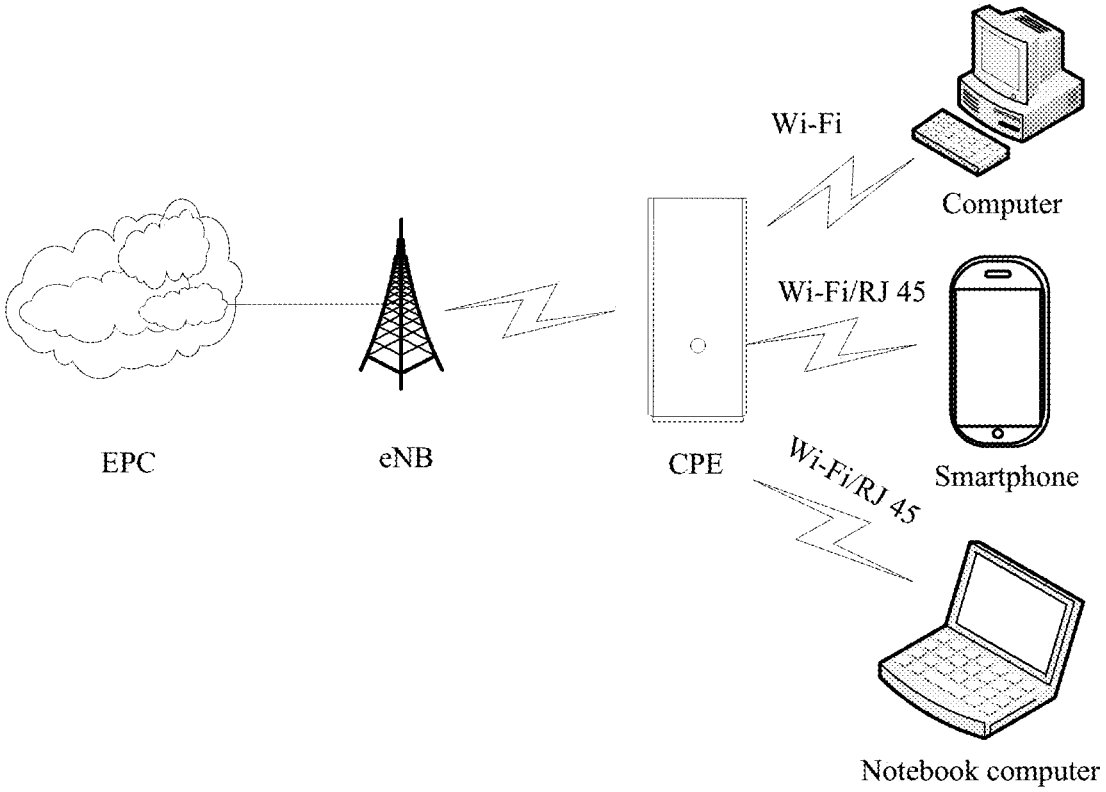
FIG. 2 is a schematic diagram of an application scenario according to an embodiment of this application.

Specifically, the antenna provided in this embodiment of this application can be applied to CPE. FIG. 2 is a schematic diagram of an application scenario according to an embodiment of this application. In an LTE system, an evolved NodeB (evolved nodeB, eNB) is connected to an evolved packet core (evolved packet core, EPC), and is configured for fast transmission of information such as voice, a text, a video, and image information. The EPC may include an MME, an SGW, a PGW, a PCRF, and other network elements. The eNB can radiate a wireless signal, and the CPE product is disposed with an antenna and may be connected to the eNB by receiving the wireless signal radiated by the eNB. The CPE converts the signal radiated by the eNB into a Wi-Fi signal, and the antenna disposed on the CPE radiates the Wi-Fi signal. A terminal device such as a computer, a smartphone, or a notebook computer may be connected to the CPE product and perform communication and the like by using the Wi-Fi signal. Therefore, if the CPE product is disposed with the antenna provided in this embodiment of this application, one antenna may be used to radiate signals in a plurality of frequency bands, for example, radiate signals in a Band41, a Band42, and a Band43. The terminal device and the like may alternatively be connected to the CPE through an RJ (registered jack) 45 interface, and performs internet access, email sending/receiving, web page browsing, file downloading, or the like by using an LTE wireless access function. Compared with an solution in which one antenna radiates a signal in one frequency band and a plurality of antennas are required to radiate those in a plurality of frequency bands, one antenna radiates signals in a plurality of frequency bands in this embodiment of this application, thereby reducing a footprint of the antenna and reducing a size of the CPE product.

Figure 3:
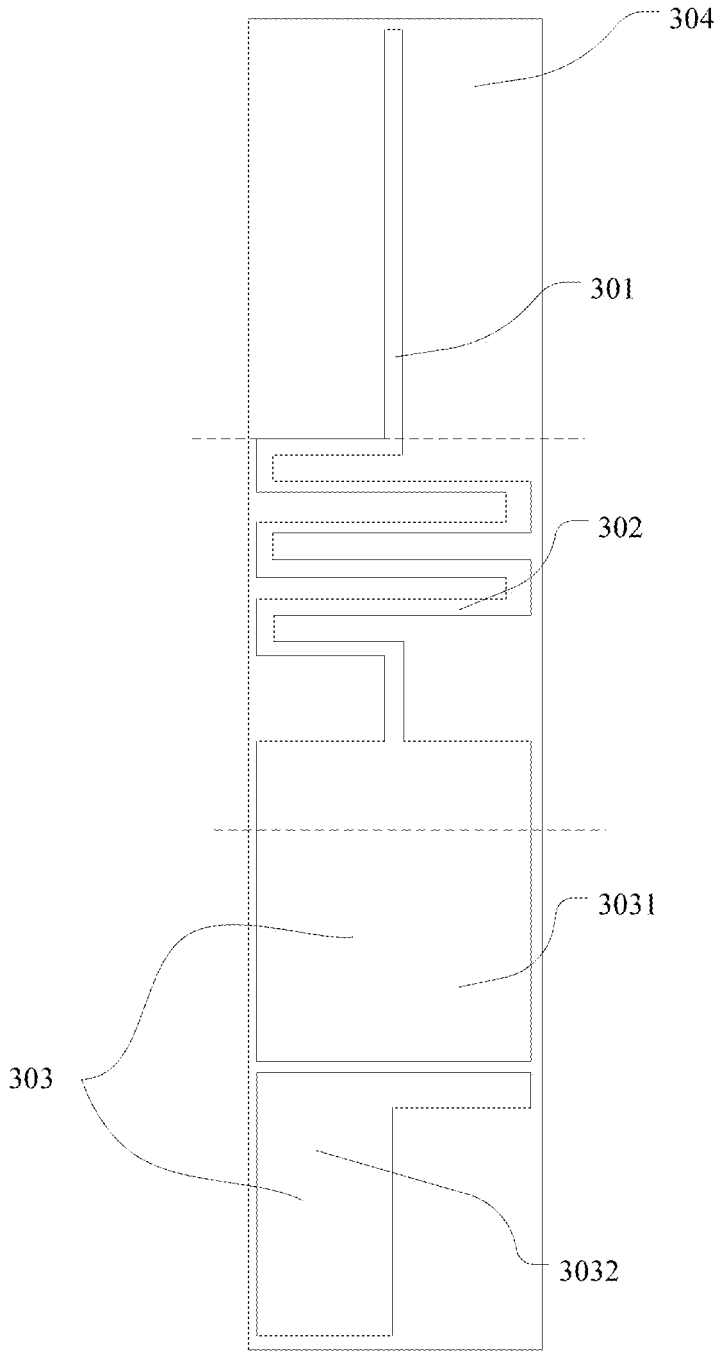
FIG. 3 is a schematic diagram of an embodiment of an antenna according to an embodiment of this application.

A wireless signal for communication between a network device and another device is usually transmitted or received by the antenna in the network device. Therefore, operating frequencies of antennas in some network devices also need to include the Band41 and the Band42, or include the Band41, the Band42, the Band43, and the like. For the antenna provided in this embodiment of this application, one antenna can implement sending and receiving in a plurality of frequency bands, and can implement horizontally high-gain omnidirectional radiation. The antenna provided in this embodiment of this application can be applied to the network device, including a router, CPE, an MS, an SS, or a mobile phone. FIG. 3 is a schematic diagram of an embodiment of an antenna according to an embodiment of this application. The antenna includes:

a top radiating element 301, a phase inversion unit 302, and a bottom radiating element 303, and a medium substrate 304, where the bottom radiating element 303 includes an upper radiating module 3031 and a lower radiating module 3032.

The medium substrate 304 is used as a carrier of the top radiating element 301, the phase inversion unit 302, and the bottom radiating element 303. A dielectric constant of the medium substrate may affect a signal radiated by the antenna, and the medium substrate can be selected depending on an actual device requirement. An end of the top radiating element 301 is connected to an end of the phase inversion unit 302, and the other end of the phase inversion unit 302 is connected to an end of the upper radiating module 3031. The phase inversion unit 302 includes a fold line part and a vertical part, and the fold line part may be folded in a spiral form. The lower radiating module 3032 and the upper radiating module 3031 are included in the bottom radiating element 303, and the other end of the upper radiating module 3021 is connected to an end of the lower radiating module 3032 through a coaxial line.

When the antenna is operating, the antenna may radiate a first signal and a second signal, where the first signal is in a first frequency band, and the second signal is in a second frequency band. The top radiating element 301 and the bottom radiating element 303 have a same current direction, and radiate or receive signals in the operating frequencies of the antenna. Currents at various parts are in opposite directions due to the spiral form, the currents inside the phase inversion unit 302 offset each other, and the phase inversion unit 302 does not radiate a signal. No radiation to be produced by the phase inversion unit 302 can reduce impact on the signals radiated by the top radiating element 301 and the bottom radiating element 301. A length of the phase inversion unit 302 may be an odd multiple of a second half-wavelength, and the length of the phase inversion unit 302 is greater than an odd multiple of a first half-wavelength. The first half-wavelength is half of a wavelength corresponding to a frequency of the first signal, and the first half-wavelength may be half of a wavelength corresponding to a center frequency of the first frequency band. The second half-wavelength is half of a wavelength corresponding to a frequency of the second signal, and the second half-wavelength may be half of a wavelength corresponding to a center frequency of the second frequency band. The first frequency band and the second frequency band are different frequency bands, and a ratio between the center frequency of the second frequency band and the center frequency of the first frequency band may range from 1.3 to 1.6. Lengths of the top radiating element 301 and the bottom radiating element 303 may be the first half-wavelength and the second half-wavelength, respectively, or odd-multiple lengths corresponding to the first half-wavelength and the second half-wavelength, respectively. Therefore, the antenna radiates signals in at least two frequency bands, and the network device can use one antenna to transmit and receive the signals in the at least two frequency bands.

The operating frequencies of the antenna provided in this embodiment of this application cover frequency ranges of the at least two frequency bands, including the first frequency band and the second frequency band. The length of the phase inversion unit 302 may be a length of the second half-wavelength, and is greater than a length of the first half-wavelength. Therefore, when the antenna is operating, the top radiating element 301 and the bottom radiating element 303 have a same current direction, and horizontally high-gain omnidirectional radiation can be implemented in the at least two frequency bands.

It should be noted that only a 1×2 dipole array antenna is used as an example for description in this embodiment of this application. 1 represents a linear array of the antenna, and 2 represents two vertical radiating elements: the top radiating element 301 and the bottom radiating element 303. The two vertical radiating elements are connected through the phase inversion unit, that is, the phase inversion unit 302. The antenna may alternatively be a 1×4 antenna, a 1×5 antenna, or another antenna, and radiating elements are connected through a phase inversion unit. When there are at least three radiating elements, at least two corresponding phase inversion units may be included. A larger quantity of radiating elements indicates a higher radiation gain of the antenna and higher radiation signal strength. A specific quantity can be adjusted depending on an actual design requirement, and is not limited herein.

Figure 4:
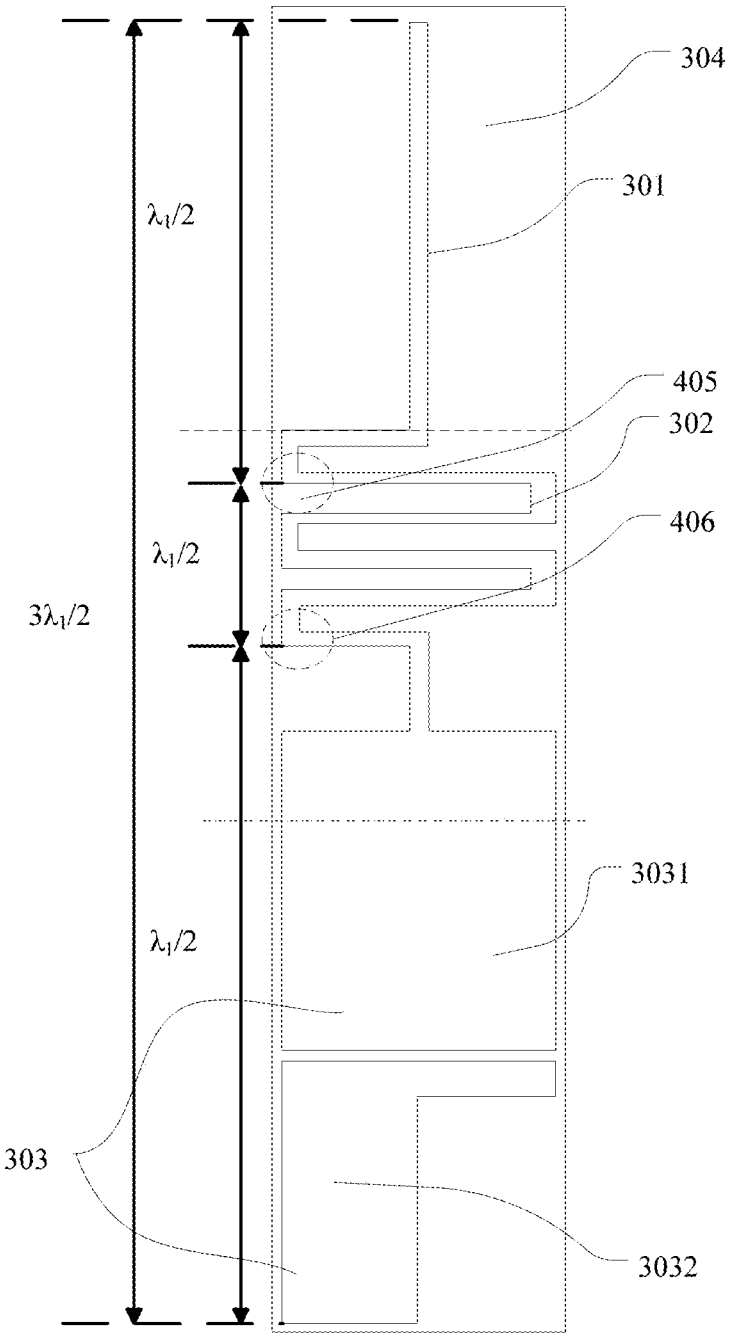
FIG. 4 is a schematic diagram of another embodiment of an antenna according to an embodiment of this application.

For different operating frequency bands of the antenna, specific currents inside the antenna flow in different directions. Coverage of the antenna includes the Band41 and the Band42. A Band41 operating mode may be shown in FIG. 4. A wavelength corresponding to a center frequency of the Band41 is $\lambda_1$, and a total length of the antenna may be three half-wavelengths corresponding to the center frequency of the Band41, that is, $3\lambda_1/2$ shown in the figure. A half-wavelength is half of the wavelength corresponding to the center frequency of the Band41, that is, half of $\lambda_1$. The phase inversion unit 302 includes two current phase inversion points: a phase inversion point 405 and a phase inversion point 406 shown in the figure. Currents at the two phase inversion points are 0. A length between the two phase inversion points is a length of one half-wavelength corresponding to the Band41, that is, $\lambda_1/2$. It can be understood that when the antenna is in the Band41 operating mode, the antenna may be divided into three parts. Because a part between the phase inversion point 405 and the phase inversion point 406 is folded, currents between the phase inversion point 405 and the phase inversion point 406 offset each other, and the part between the phase inversion point 405 and the phase inversion point 406 does not produce radiation. The two parts other than the part between the phase inversion point 405 and the phase inversion point 406, that is, the top radiating element 301 and the bottom radiating element 303, radiate a signal. Lengths of radiated signals in the two parts may each include the length of the half-wavelength corresponding to the Band41.

Figure 5:
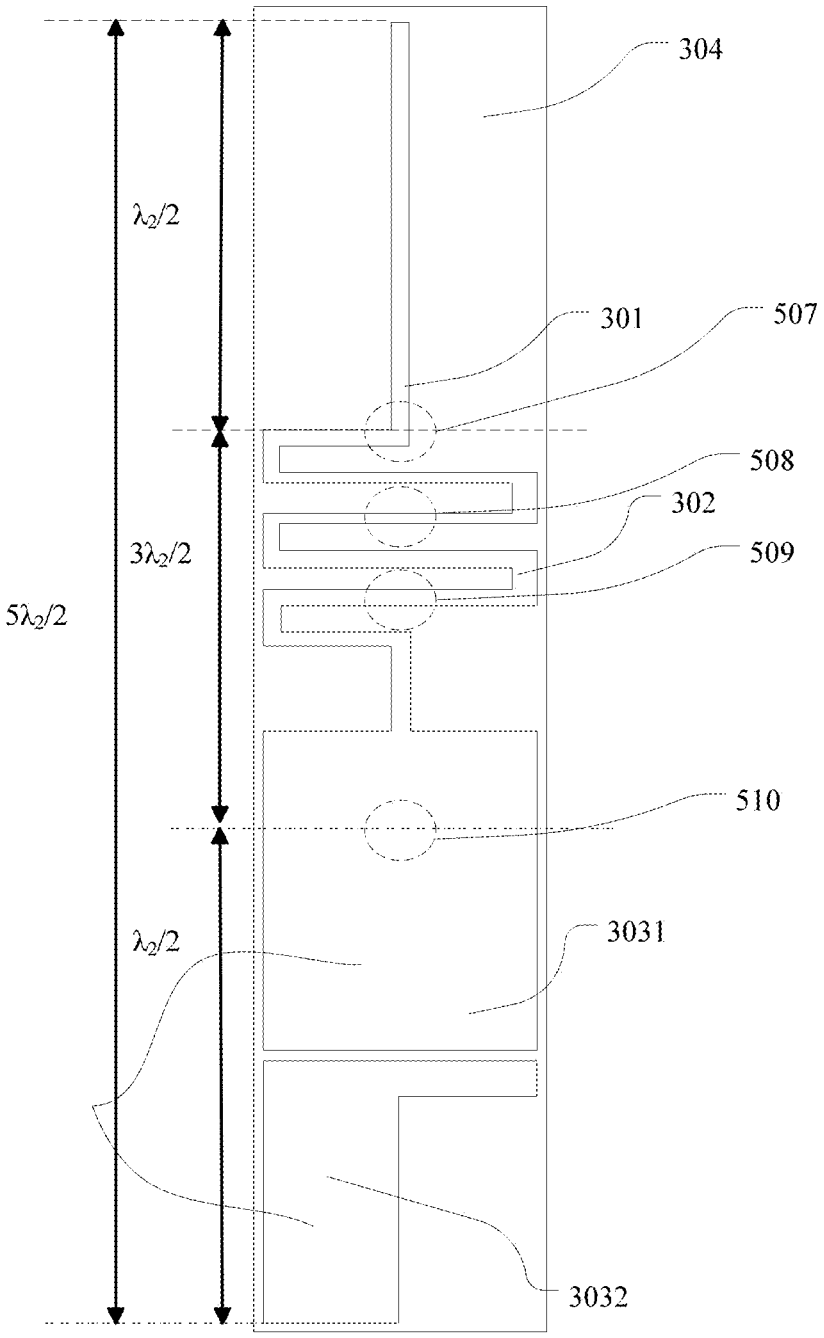
FIG. 5 is a schematic diagram of another embodiment of an antenna according to an embodiment of this application.

A Band42 operating mode may be shown in FIG. 5. A wavelength corresponding to a center frequency of the Band42 is $\lambda_2$, and a total length of the antenna may be five half-wavelengths corresponding to the Band42, that is, $5\lambda_2/2$ shown in the figure. A half-wavelength is half of the wavelength corresponding to the center frequency of the Band42, that is, half of $\lambda_2$ shown in the figure. The phase inversion unit portion 302 includes four current phase inversion points: a phase inversion point 507, a phase inversion point 508, a phase inversion point 509, and a phase inversion point 510. Currents at the four current phase inversion points are 0. A length between the phase inversion point 507 and the phase inversion point 510 is a length of three half-wavelengths corresponding to the Band42, that is, $3\lambda_2/2$ shown in the figure. It can be understood that when the antenna is in the Band42 operating mode, the antenna may be divided into three parts: the top radiating element 301, the bottom radiating element 303, and the phase inversion unit 302. Because the phase inversion unit 302 is folded, internal currents are in opposite directions and offset each other, and the phase inversion unit 302 does not produce radiation. In this case, the top radiating element 301 and the bottom radiating element 303 other than the phase inversion unit 302 radiate signals. Lengths of radiated signals in the two parts may each include a length of the half-wavelength corresponding to the Band42, that is, $\lambda_2/2$ shown in the figure.

Therefore, the antenna provided in this embodiment of this application can radiate signals in at least two frequency bands that may include the frequency bands Band41 and Band42 in an LTE system. In this way, one antenna radiates the signals in the at least two frequency bands in a horizontal direction. Compared with an existing solution in which one antenna radiates a signal in one frequency band and at least two corresponding antennas are required for at least two frequency bands, the antenna provided in this embodiment of this application has a smaller size for implementing radiation in the at least two frequency bands, and costs of the network device using the antenna are reduced.

Figure 6:
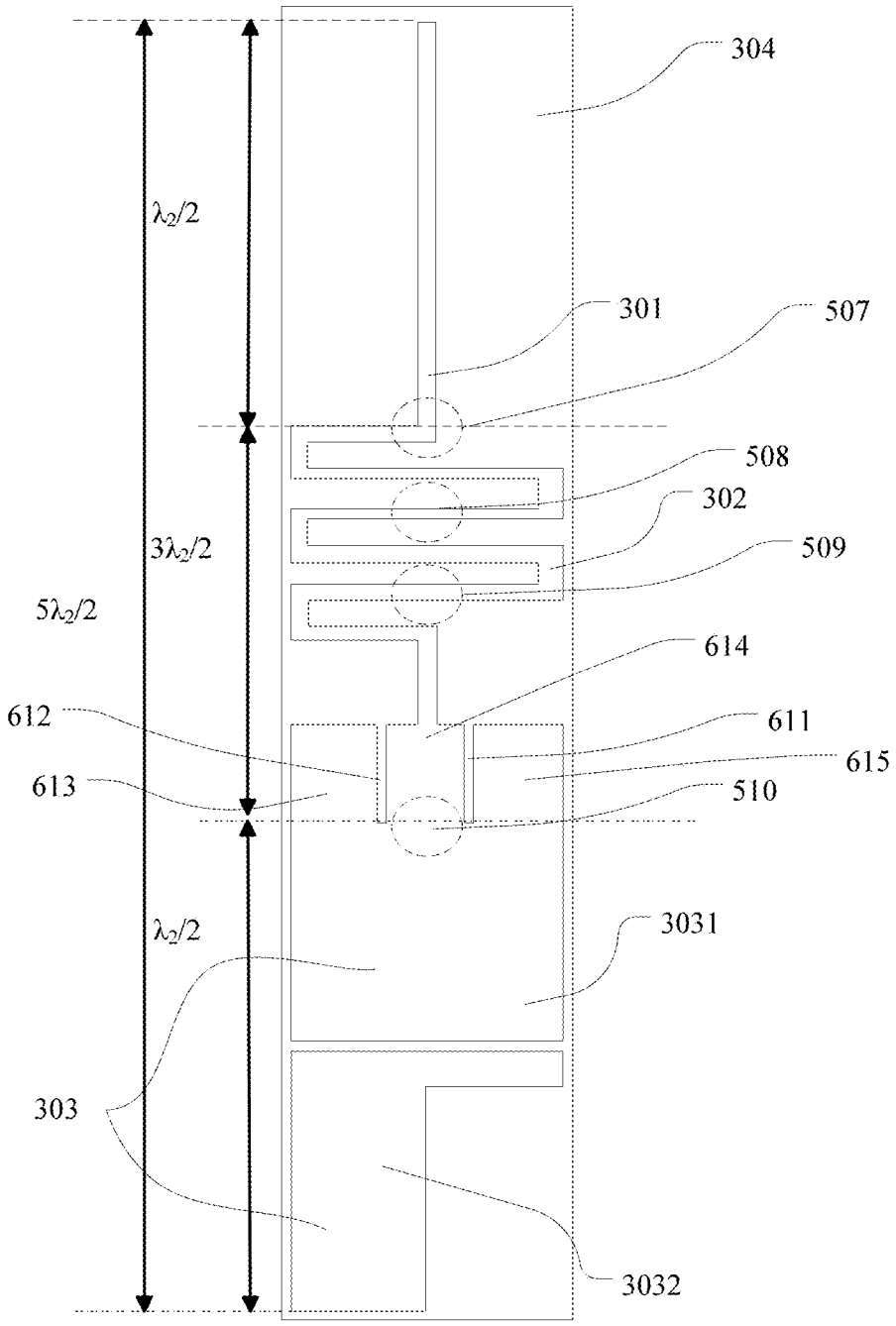
FIG. 6 is a schematic diagram of another embodiment of an antenna according to an embodiment of this application.

In addition, to further make antenna radiation in the Band42 closer to a horizontal direction, a slot may be further added to the phase inversion unit portion 302. Details may be shown in FIG. 6. A first slot and a second slot, that is, a slot 611 and a slot 612, are added; and a first microstrip, a second microstrip, and a third microstrip, that is, a microstrip 613, a microstrip 614, and a microstrip 615, are obtained. Due to presence of the slot 611 and the slot 612, currents generated at the microstrip 613 and the microstrip 65 may be in opposite directions to that of a current at the microstrip 614. When the antenna is operating, the currents at the microstrip 613 and the microstrip 65 can offset the current at the microstrip 614. In other words, the microstrip 614 does not produce radiation even when the antenna is in the Band42 operating mode. To be specific, the microstrip 613 and the microstrip 65 may generate the currents in opposite directions to that of a current between the phase inversion point 510 and the phase inversion point 509, to offset a part of the current between the phase inversion point 510 and the phase inversion point 509. This reduces radiation produced by a part between the phase inversion point 510 and the phase inversion point 509, thereby implementing antenna side lobe suppression when the antenna operates in the Band42 mode. When the antenna operates in the Band41 mode, the slot 611 and the slot 612 are not located between the phase inversion point 405 and the phase inversion point 406, and therefore there is no impact on the Band41 mode.

Figure 7:
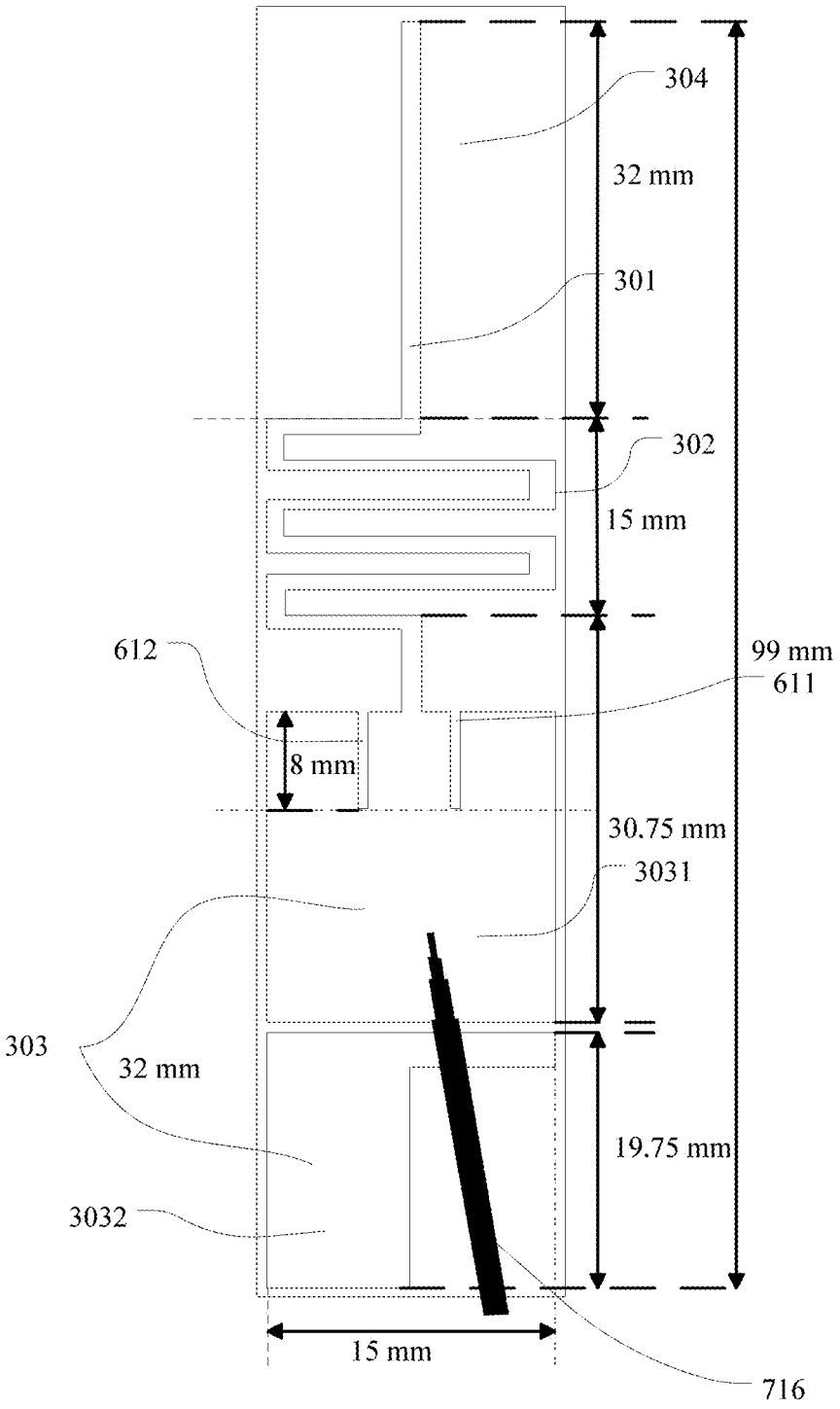
FIG. 7 is a schematic diagram of another embodiment of an antenna according to an embodiment of this application.

The following uses specific embodiments to specifically describe the antenna provided in this embodiment of this application. A length of the antenna in this embodiment of this application is first described by using an example. FIG. 7 shows another embodiment of an antenna according to an embodiment of this application.

The length of the antenna may be determined based on a wavelength corresponding to an operating frequency band of the antenna. A specific calculation method may be $\lambda=v/f$, where $\lambda$ is a wavelength corresponding to a center frequency of the operating frequency band, v is a propagation speed of an electromagnetic wave in a medium, and f is the center frequency corresponding to the current operating frequency band. Therefore, through calculation for a frequency band Band41 and a frequency band Band42, it can be learnt that the total length of the antenna may be 99 mm, a length of a top radiating element 301 is 32 mm, a length of a fold part of a phase inversion unit 302 is 15 mm, a sum of lengths of a vertical part of the phase inversion unit 302 and an upper radiating module 3031 is 30.75 mm, and a length of a lower radiating module 3032 is 19.75 mm. In addition, if the phase inversion unit 302 includes a slot 611 and a slot 612, heights of the slot 611 and the slot 612 may be both 8 mm, and the slot 611 and the slot 612 in the phase inversion unit 302 may be deep enough to reach a phase inversion point 510, so as to offset a part of a current between the phase inversion point 510 and a phase inversion point 509 in a Band42 mode of the antenna, thereby reducing an antenna side lobe when the antenna operates in the Band42 mode.

The antenna may be fed by using a coaxial line. The upper radiating module 3031 is connected to a conductor inside the coaxial line 716, and the conductor inside the coaxial line may be welded to the upper radiating module 3031. Because a lower radiating module 4062 is in an "L" shape, a body of the coaxial line 716 may be disposed in a blank part of the lower radiating module 3032, so as to reduce contact between the coaxial line 716 and the antenna body, thereby reducing impact of the coaxial line 716 on a signal radiated or received by the antenna.

Figure 8:
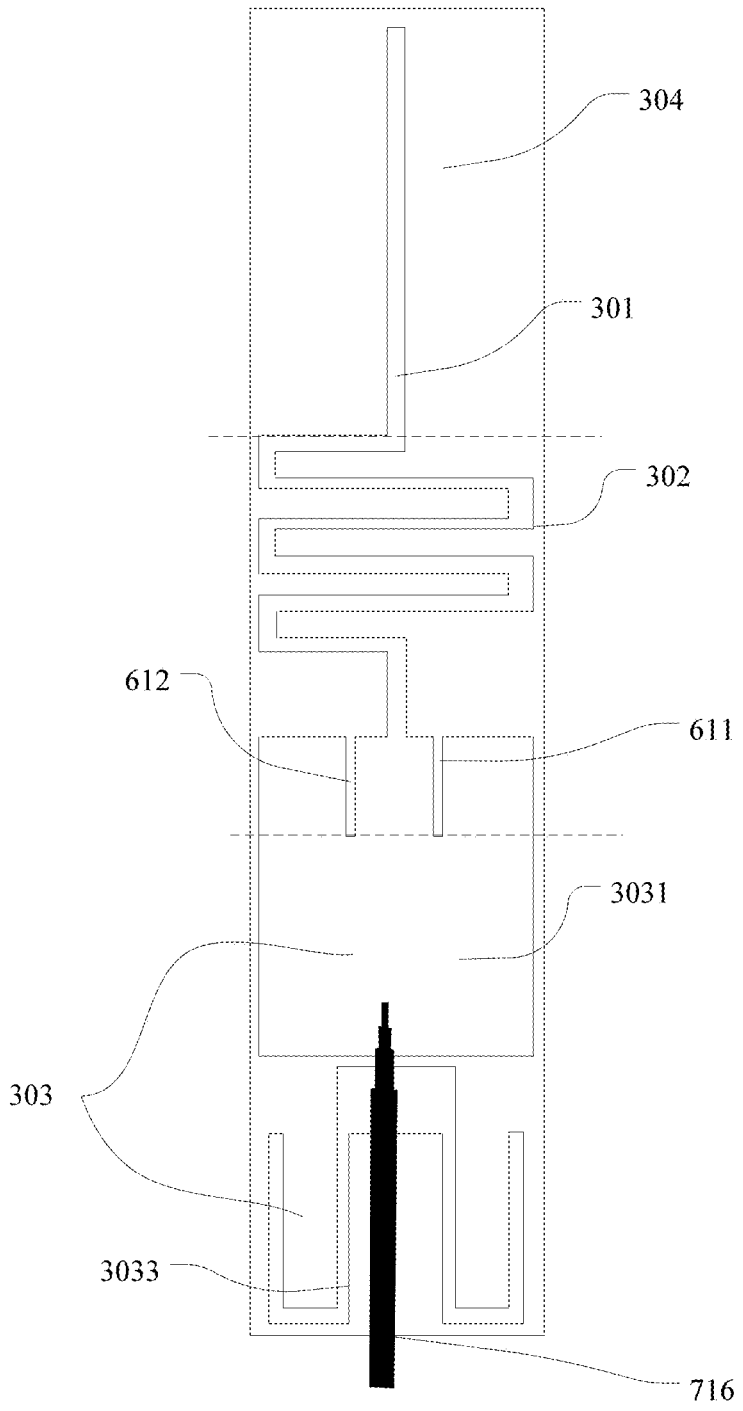
FIG. 8 is a schematic diagram of another embodiment of an antenna according to an embodiment of this application.

In addition to the "L" shape, the lower radiating module 3032 may alternatively be in a "W" shape or another shape. This is not specifically limited herein. The "W" shape is shown in FIG. 8. The conductor inside the coaxial line 716 is connected to the upper radiating module 3031, and a shield layer is close to a lower radiating module 3033. The coaxial line 716 is disposed at the bottom, that is, in the blank area of the lower radiating module 3033 as much as possible, so as to reduce contact between the coaxial line 716 and the antenna body, thereby reducing impact of the coaxial line 716 on a signal transmitted or received by the antenna.

It should be noted that this embodiment of this application provides only one schematic diagram of the length of the antenna. The total length of the antenna is three half-wavelengths corresponding to a center frequency of the Band41 and five half-wavelengths corresponding to a center frequency of the Band42. In addition, the length of the antenna may alternatively be five half-wavelengths corresponding to the center frequency of the Band41, seven half-wavelengths corresponding to the center frequency of the Band42, or the like. This is not specifically limited herein.

Specifically, the following details the antenna provided in this embodiment of this application through actual simulation.

Figure 9A:
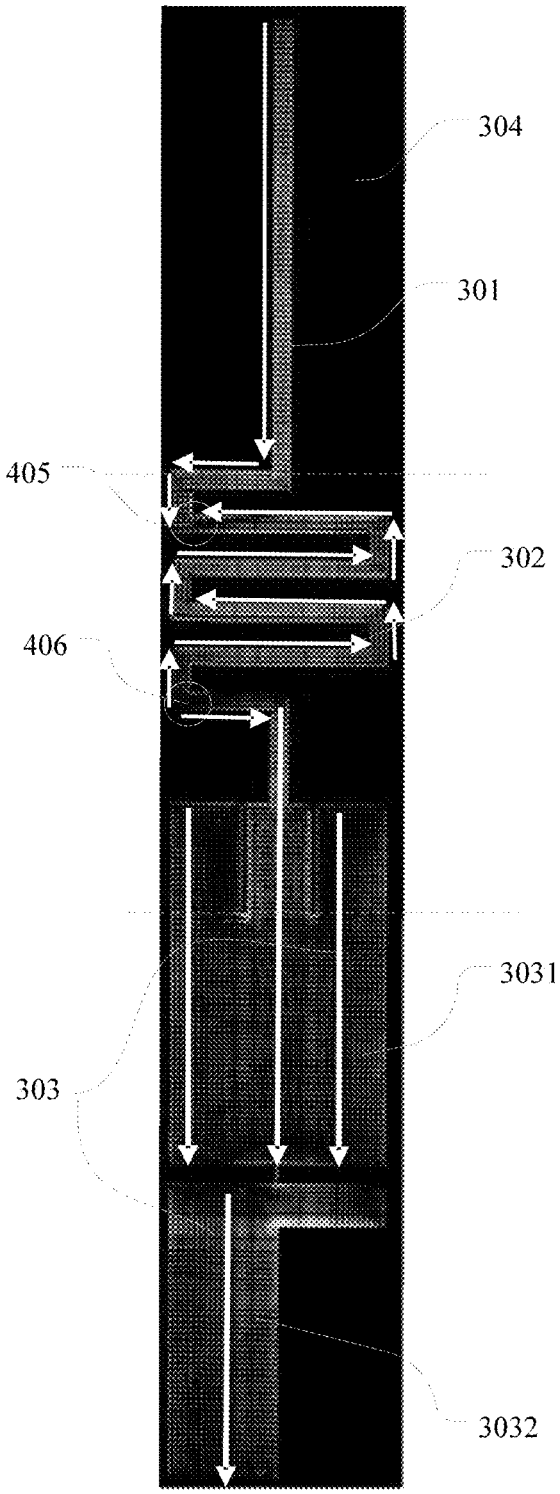
FIG. 9A is a current distribution diagram of an antenna according to an embodiment of this application.
Figure 9B:
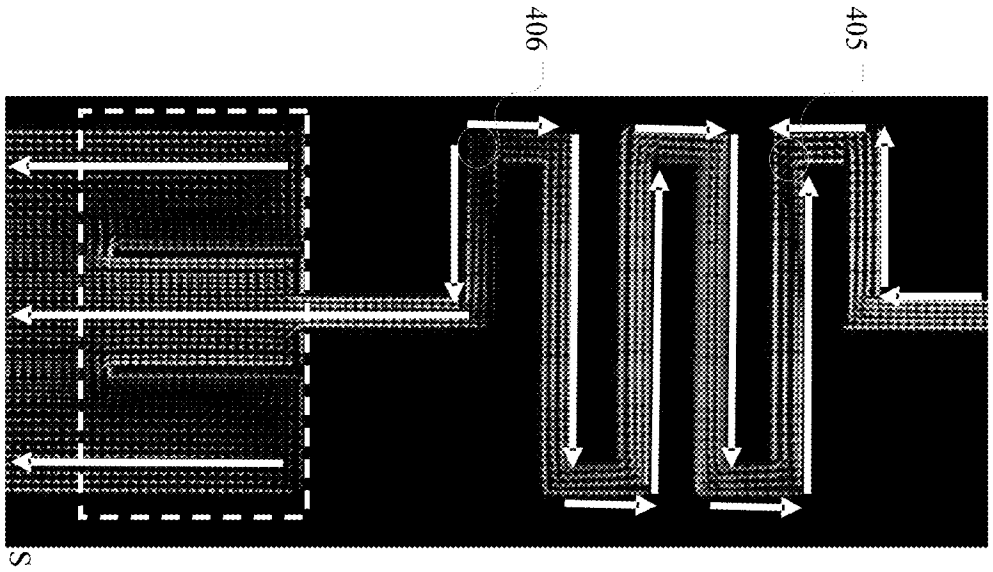
FIG. 9B is another current distribution diagram of an antenna according to an embodiment of this application.

Referring to FIG. 9A and FIG. 9B, FIG. 9A is a current distribution diagram when an operating center frequency of an antenna is 2.6 GHz in an embodiment of this application, and FIG. 9B is a current distribution diagram of a phase inversion unit when an operating center frequency of an antenna is 2.6 GHz in an embodiment of this application. It can be learnt from FIG. 9A and FIG. 9B that a phase inversion point 405 and a phase inversion point 406 are current phase inversion points, and a current obtained after phase inversion currents offset each other is 0. Currents at a top radiating element 301 and a bottom radiating element 303 are in a same direction. Because a phase inversion unit 302 is folded, internal currents are in opposite directions and offset each other, and the phase inversion unit 302 does not produce radiation. In this way, the antenna can increase an antenna gain during signal radiation in a frequency band Band41, and a current around a slot is in a same direction as the current at the bottom radiating element 303. Therefore, the slot imposes quite slight impact on a Band41 operating mode of the antenna.

Figure 10A:
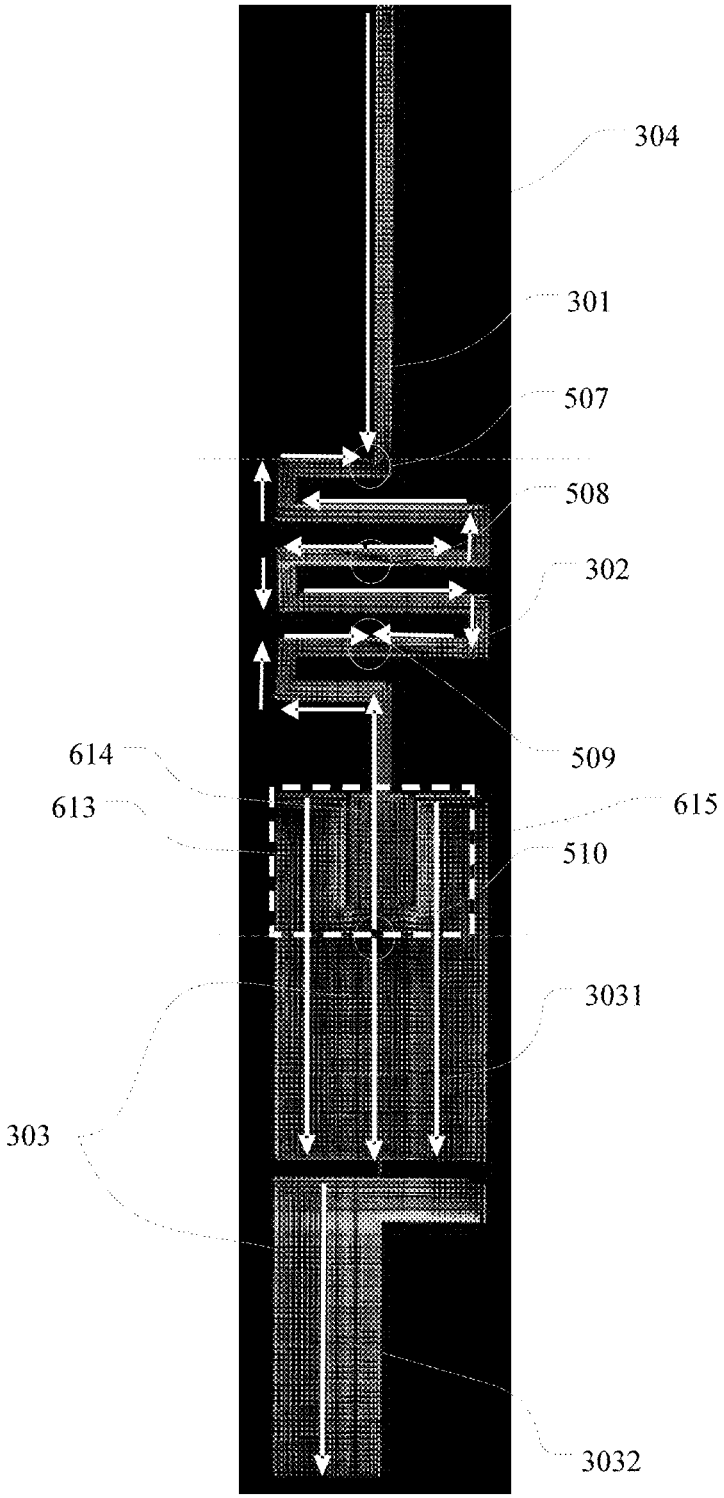
FIG. 10A is another current distribution diagram of an antenna according to an embodiment of this application.
Figure 10B:
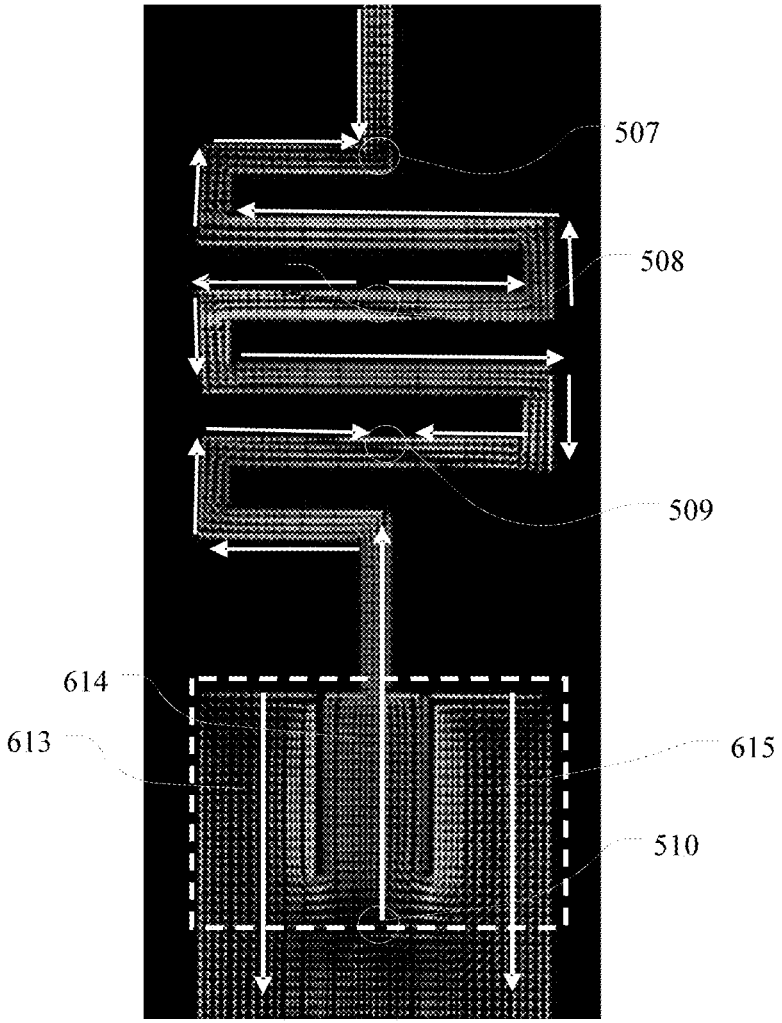
FIG. 10B is another current distribution diagram of an antenna according to an embodiment of this application.

In respect of whether a slot in the phase inversion unit 302 of the antenna in this embodiment of this application imposes relatively great impact on a frequency band whose center frequency is 3.5 GHz, the following describes impact of the slot in the phase inversion unit of the antenna in this embodiment of this application on the frequency band whose center frequency is 3.5 GHz. Referring to FIG. 10A and FIG. 10B, FIG. 10A is a current distribution diagram of an antenna with a slot at a center frequency of 3.5 GHz in an embodiment of this application, and FIG. 10B is a current distribution diagram of a phase inversion unit for an antenna with a slot at a center frequency of 3.5 GHz in an embodiment of this application. It can be learnt from FIG. 10A and FIG. 10B that a top radiating element 301 and a bottom radiating element 303 have a same current direction and radiate a signal whose center frequency is 3.5 GHz. Because a phase inversion unit 302 is folded, internal currents are in opposite directions and offset each other. Currents whose directions are opposite to that of a current at a microstrip 614 are generated on two sides of the slot, that is, on a microstrip 613 and a microstrip 615. As a result, a phase inversion current at the microstrip 614 on a phase inversion point 510 becomes narrower, and the currents at the microstrip 613 and the microstrip 615 are in opposite directions to that of the current at the microstrip 614. In this case, the currents at the microstrip 613 and the microstrip 65 can offset a current, at a portion of the microstrip 614, whose direction is opposite to those of the currents at the microstrip 613 and the microstrip 615, thereby reducing radiation produced by the microstrip 615.

Figure 11A:
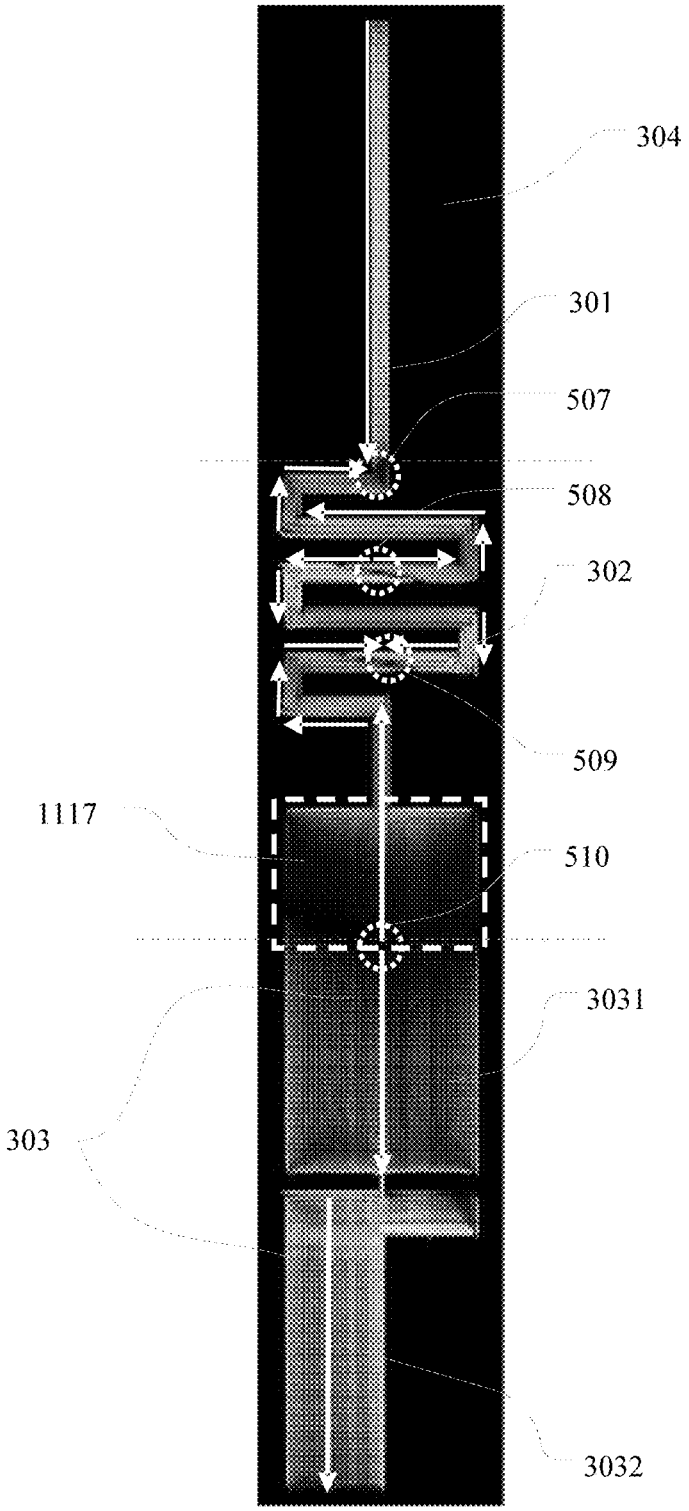
FIG. 11A is another current distribution diagram of an antenna according to an embodiment of this application.
Figure 11B:
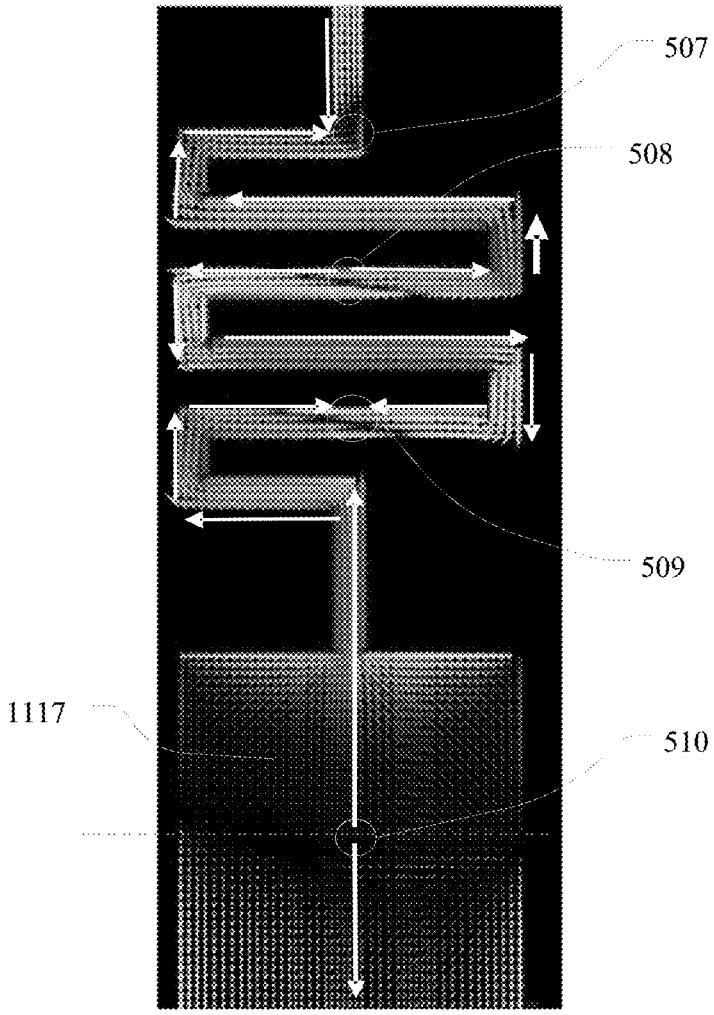
FIG. 11B is another current distribution diagram of an antenna according to an embodiment of this application.

The foregoing describes the current distribution diagram of the antenna with a slot in the frequency band whose center frequency is 3.5 GHz, and the following describes current distribution of an antenna without a slot in the frequency band whose center frequency is 3.5 GHz, to compare in more detail impact imposed by a slot. Referring to FIG. 11A and FIG. 1B, FIG. 11A is a current distribution diagram of an antenna without a slot at a center frequency of 3.5 GHz in an embodiment of this application, and FIG. 11B is a current distribution diagram of a phase inversion unit for an antenna without a slot at a center frequency of 3.5 GHz in an embodiment of this application. It can be learnt from FIG. 11A and FIG. 11B that, when the antenna without a slot is in the frequency band whose center frequency is 3.5 GHz, a microstrip portion, that is, a microstrip 1117, of the phase inversion unit 302 has a phase inversion current whose width on the antenna is greater than that of the microstrip portion 615 of the antenna with a slot, and the microstrip 1117 has an electrical length shorter than that of the microstrip 614; and the microstrip 1117 has a current direction opposite to those of a top radiating element 301 and a bottom radiating element 303. When the antenna is in an operating mode for the frequency band whose center frequency is 3.5 GHz, the microstrip 1117 produces radiation, affecting signal radiation in the frequency band whose center frequency is 3.5 GHz.

Figure 12:
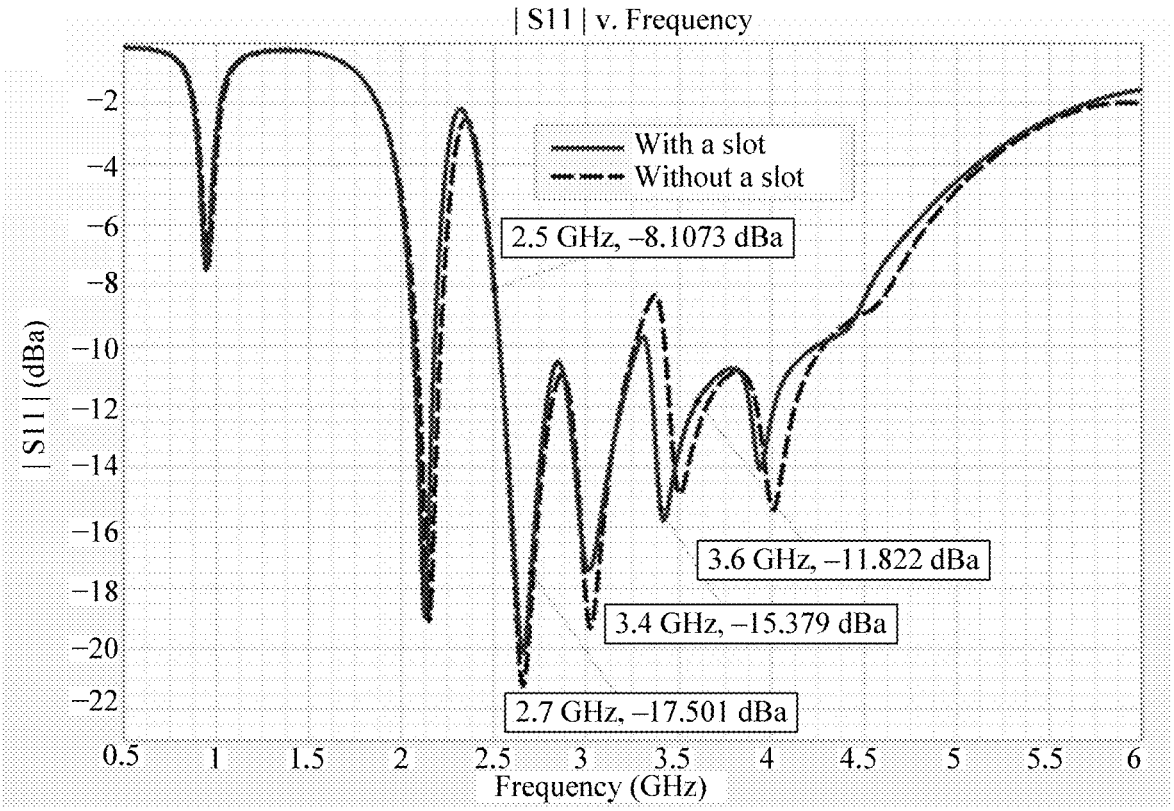
FIG. 12 is a schematic diagram of a return loss of an antenna according to an embodiment of this application.

Therefore, through comparison between simulation diagrams provided in FIG. 9 to FIG. 1B, a slot 611 and a slot 612 impose relatively large impact on horizontal radiation in the Band42, to make signal radiation of the antenna in the frequency band Band42 closer to a horizontal direction, thereby reducing an antenna side lobe. The following details impact of the slot 611 and the slot 612 on an antenna in an embodiment of this application. FIG. 12 is a comparison diagram of a return loss of an antenna according to an embodiment of this application.

It can be learnt from FIG. 12 that return losses of the antenna in this embodiment of this application in all frequency bands Band41, Band42, and Band43 are less than −10 dB. Therefore, the antenna can be in an operating state in all the frequency bands Band41, Band42, and Band43. It can be learnt through comparison that a resonance frequency of an antenna with a slot near 2.6 GHz and 3.5 GHz is lower than that of an antenna without a slot. The resonance frequency covered by the antenna without a slot is higher than that of the antenna with a slot and the antenna without a slot cannot completely cover the frequency band Band42. In contrast, the antenna with a slot can completely cover the frequency band Band42. Therefore, a slot added to a phase inversion unit can make an antenna completely cover the frequency band Band42. To further make a radiation direction of the antenna in this embodiment of this application closer to a horizontal direction, the following further describes impact of a slot on the antenna in the frequency band Band41 in this embodiment of this application with reference to FIG. 12, FIG. 13A, and FIG. 13B by using specific simulation diagrams.

Figure 13A:
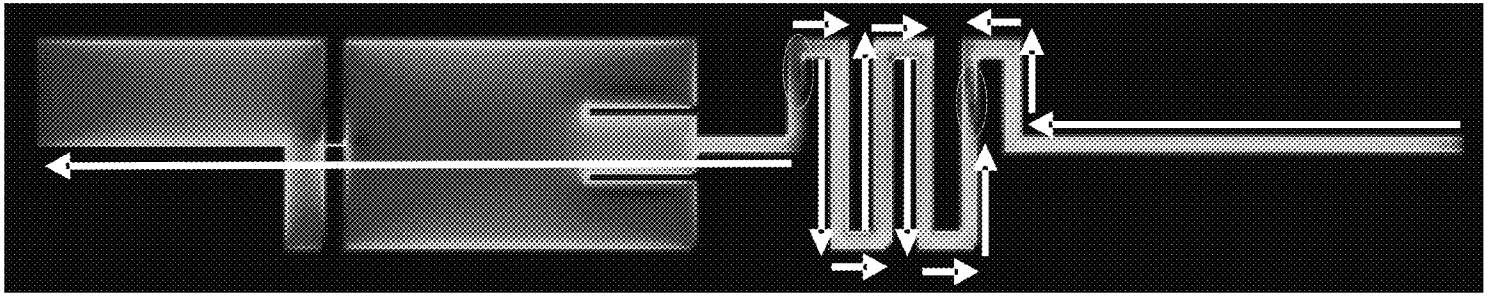
FIG. 13A is another current distribution diagram of an antenna according to an embodiment of this application.
Figure 13B:
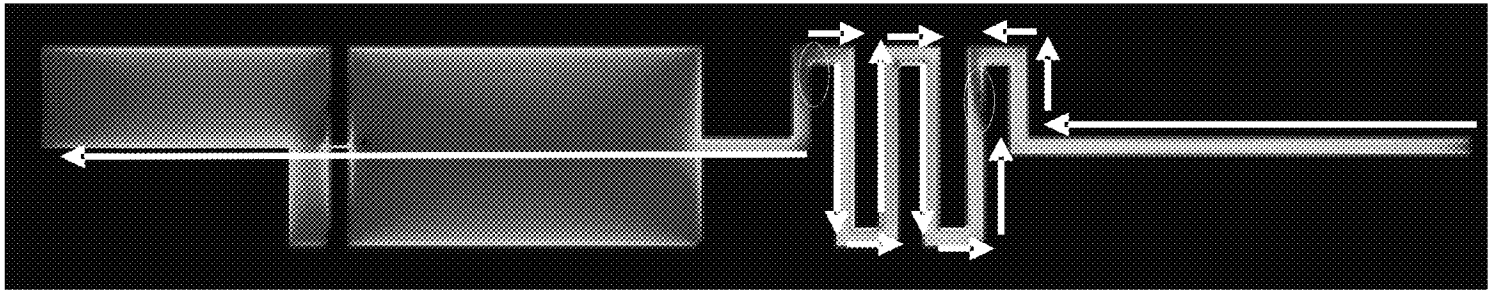
FIG. 13B is another current distribution diagram of an antenna according to an embodiment of this application.
Figure 14:
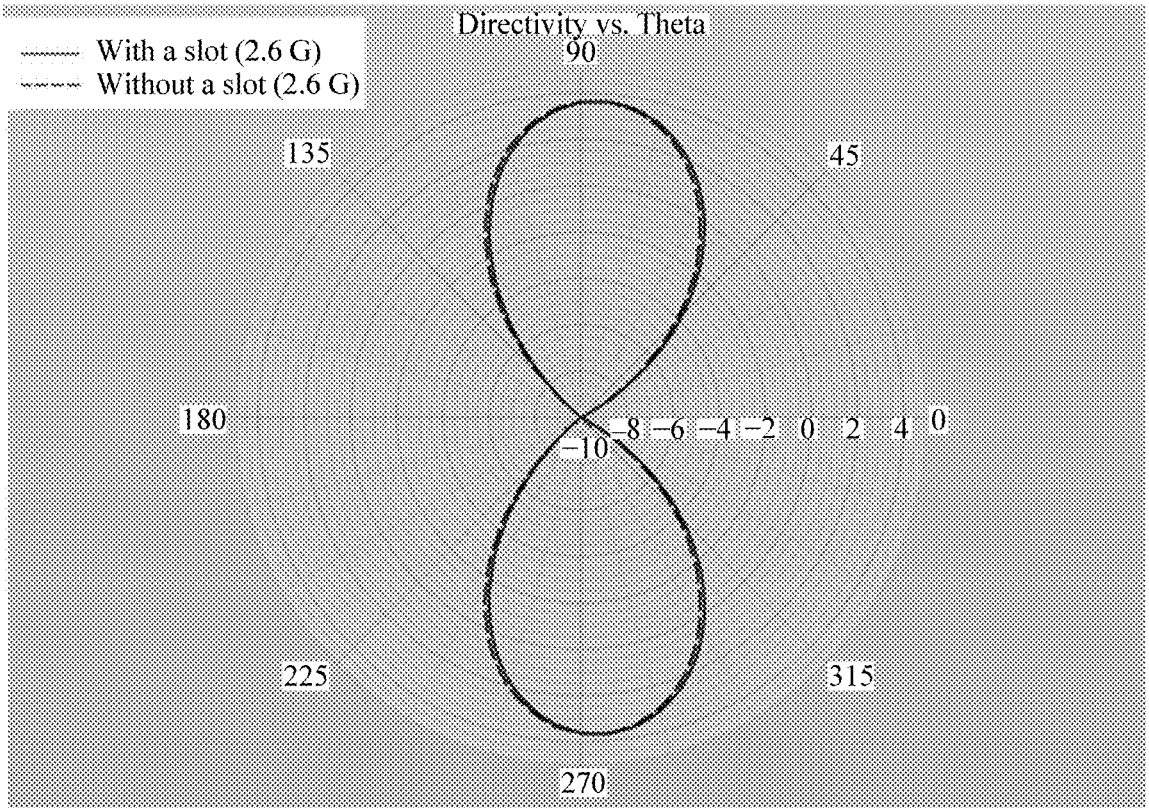
FIG. 14 is a diagram of a radiation pattern of an antenna according to an embodiment of this application.

A current distribution simulation diagram of an antenna with a slot in the frequency band Band41 whose center frequency is 2.6 GHz is shown in FIG. 13A, and a current distribution simulation diagram of an antenna without a slot in the frequency band Band41 is shown in FIG. 13B. It can be learnt from FIG. 13A and FIG. 13B that current distribution of the antenna with a slot in the frequency band Band41 and current distribution of the antenna without a slot in the frequency band Band41 are similar to those in FIG. 9A and FIG. 9B. In current phase inversion points circled in FIG. 13A and FIG. 13B, phase inversion points of the antenna with a slot are also consistent with phase inversion points of the antenna without a slot. FIG. 14 shows a comparison between the antenna with a slot and the antenna without a slot in the frequency band Band41 in a vertical direction in an embodiment of this application. It can be learnt from FIG. 14 that a radiation pattern of the antenna with a slot in the vertical direction is similar to that of the antenna without a slot in the vertical direction. Therefore, adding the slot 611 and the slot 612 to the phase inversion unit 302 imposes quite slight impact on a Band4 operating mode of the antenna.

Figure 15A:
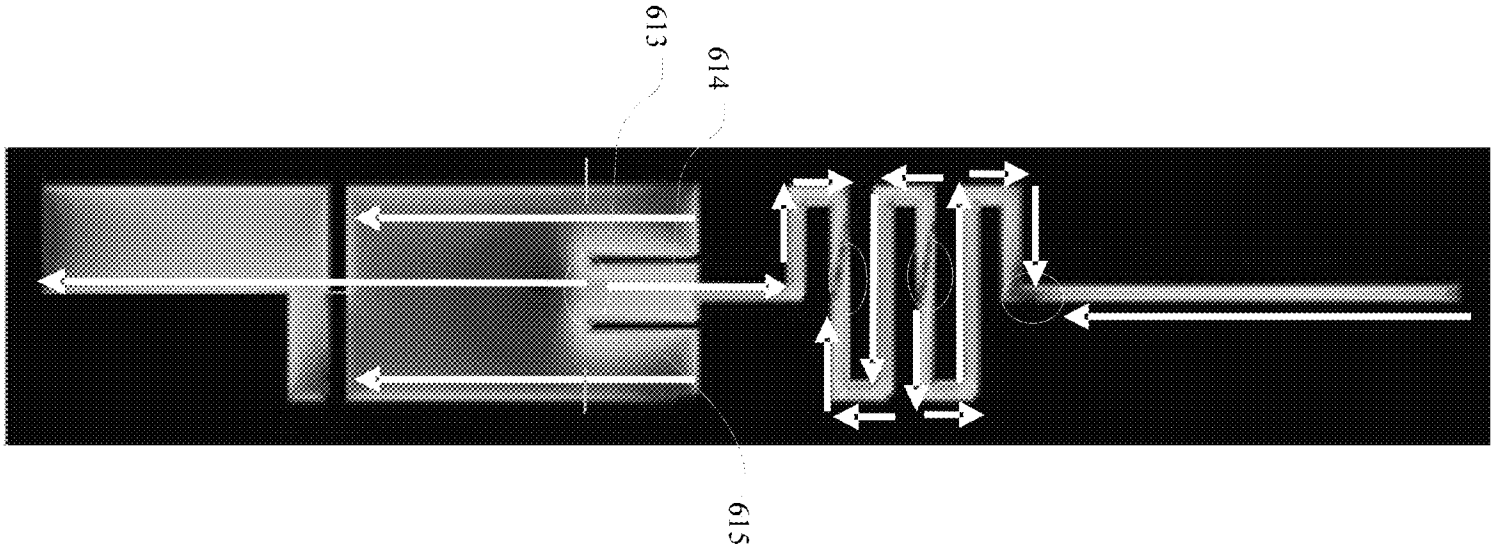
FIG. 15A is another current distribution diagram of an antenna according to an embodiment of this application.
Figure 15B:
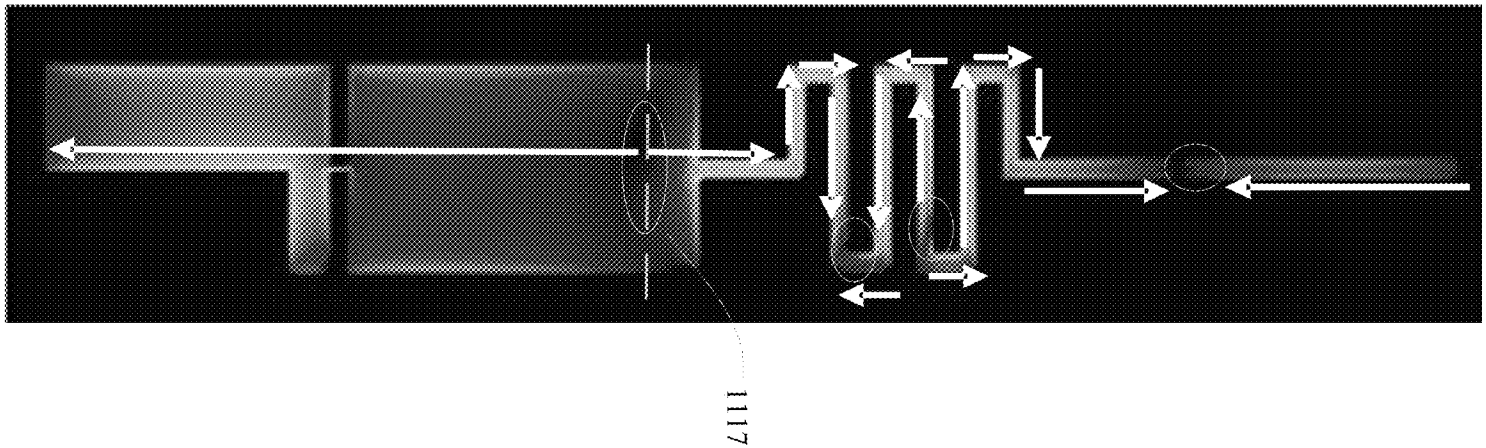
FIG. 15B is another current distribution diagram of an antenna according to an embodiment of this application.
Figure 16:
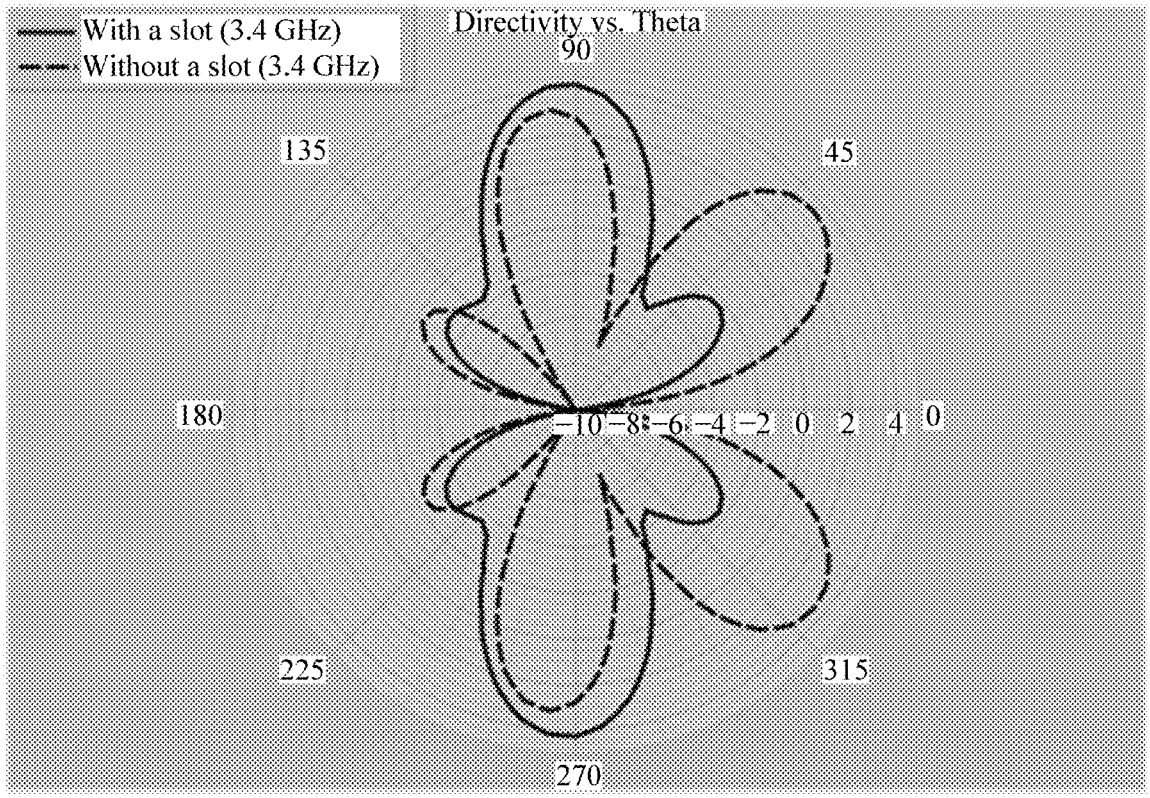
FIG. 16 is another diagram of a radiation pattern of an antenna according to an embodiment of this application.

A current distribution simulation diagram of an antenna with a slot in a frequency band Band42 whose center frequency is 3.4 GHz is shown in FIG. 15A, and a current distribution simulation diagram of an antenna without a slot is shown in FIG. 15B. It can be learnt from FIG. 15A and FIG. 5B that a width of a microstrip 1117 of the antenna without a slot is greater than that of a microstrip 614 of the antenna with a slot, and an electrical length of the microstrip 1117 of the antenna without a slot is shorter than that of the microstrip 614 of the antenna with a slot. Parts circled in FIG. 15A and FIG. 15B are current phase inversion points. For the antenna with a slot, currents whose directions are opposite to that of a current at the microstrip 614 are generated on two sides of the slot, that is, on a microstrip 613 and a microstrip 65. This makes a width of a phase inversion current at the microstrip 614 of the phase inversion unit become smaller, makes the phase inversion current at the microstrip 614 more evenly distributed, increases the electrical length of the microstrip 614, and makes impedance more matched, thereby achieving an effect of inductive load. Compared with the antenna without a slot, a resonance frequency of a mode with five half-wavelengths drifts towards a low frequency, and therefore the antenna with a slot can completely cover the frequency band Band42. FIG. 16 shows a comparison between the antenna with a slot and the antenna without a slot at 3.4 GHz in the frequency band Band42 in a vertical direction in an embodiment of this application. It can be learnt from FIG. 16 that, compared with a radiation pattern of the antenna without a slot in the vertical direction, a radiation pattern of the antenna with a slot in the vertical direction has a smaller quantity of antenna side lobes and radiation of main lobes tend to be closer to a horizontal direction. Therefore, compared with the antenna without a slot, the antenna with a slot has an antenna radiation direction, at the center frequency of 3.4 GHz, that tends to be closer to a horizontal direction, and the antenna with a slot can have a smaller quantity of antenna side lobes in the frequency band whose center frequency is 3.4 GHz.

Figure 17A:
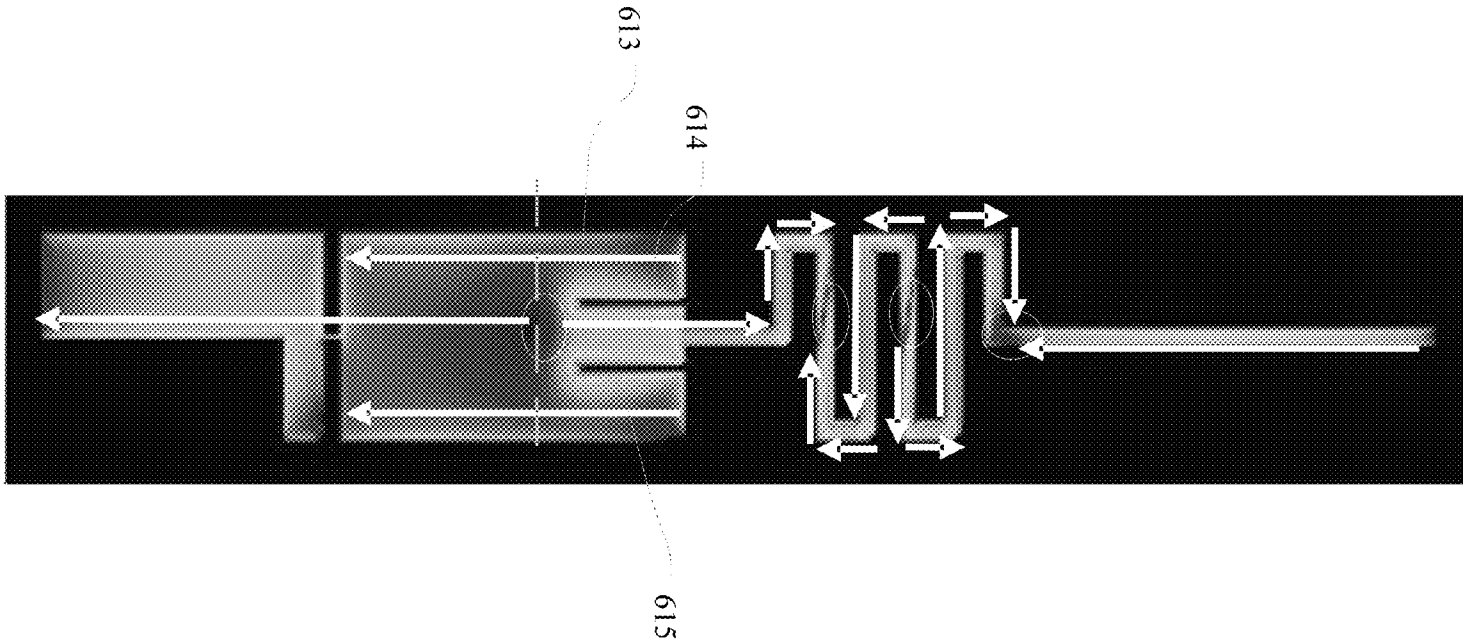
FIG. 17A is another current distribution diagram of an antenna according to an embodiment of this application.
Figure 17B:
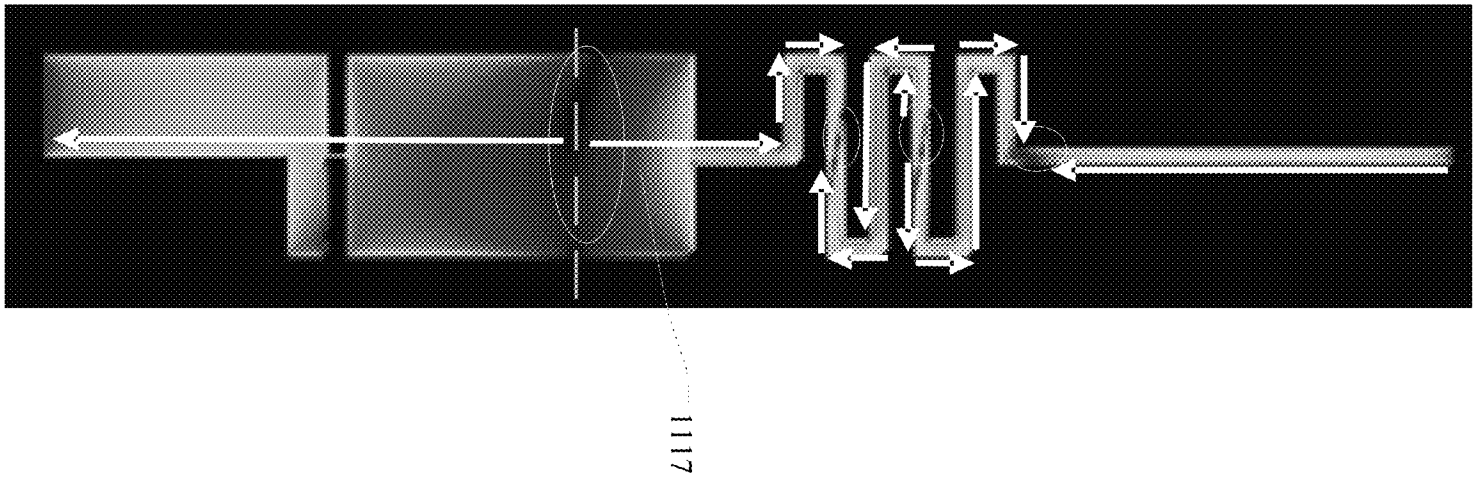
FIG. 17B is another current distribution diagram of an antenna according to an embodiment of this application.
Figure 18:
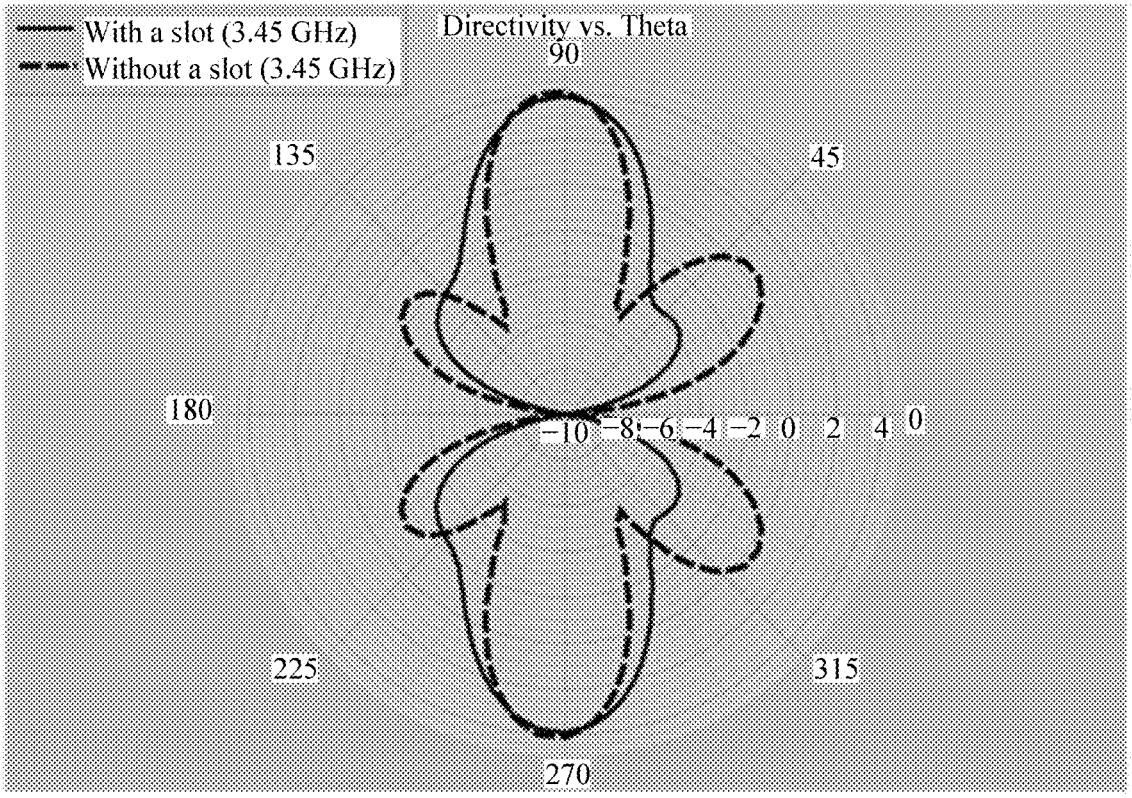
FIG. 18 is another diagram of a radiation pattern of an antenna according to an embodiment of this application.

A current distribution simulation diagram of an antenna with a slot in a frequency band Band42 whose center frequency is 3.45 GHz is shown in FIG. 17A, and a current distribution simulation diagram of an antenna without a slot is shown in FIG. 17B. It can be learnt from FIG. 17A and FIG. 17B that a microstrip 1117 of the antenna without a slot is wider, and an electrical length of the microstrip 1117 is shorter than that of a microstrip 614 of the antenna with a slot. Parts circled in FIG. 17A and FIG. 17B are current phase inversion points. The antenna with a slot generates currents in opposite directions on two sides of the slot. This makes a width of a phase inversion current at the microstrip 614 of the phase inversion unit become smaller, makes the phase inversion current at the phase inversion unit more evenly distributed, increases the electrical length, and makes impedance more matched, thereby achieving an effect of inductive load. Compared with the antenna without a slot, a resonance frequency of a mode with five half-wavelengths drifts towards a low frequency, and therefore the antenna with a slot can completely cover the frequency band Band42. FIG. 18 shows a comparison between the antenna with a slot and the antenna without a slot at 3.45 GHz in the frequency band Band42 in a vertical direction in an embodiment of this application. It can be learnt from FIG. 18 that, compared with a radiation pattern of the antenna without a slot in the vertical direction, a radiation pattern of the antenna with a slot in the vertical direction has a smaller quantity of antenna side lobes and radiation of main lobes tend to be closer to a horizontal direction. Therefore, compared with the antenna without a slot, the antenna with a slot has an antenna radiation direction, at the center frequency of 3.45 GHz, that tends to be closer to a horizontal direction, and the antenna with a slot can have a smaller quantity of antenna side lobes in the frequency band whose center frequency is 3.45 GHz.

Figure 19:
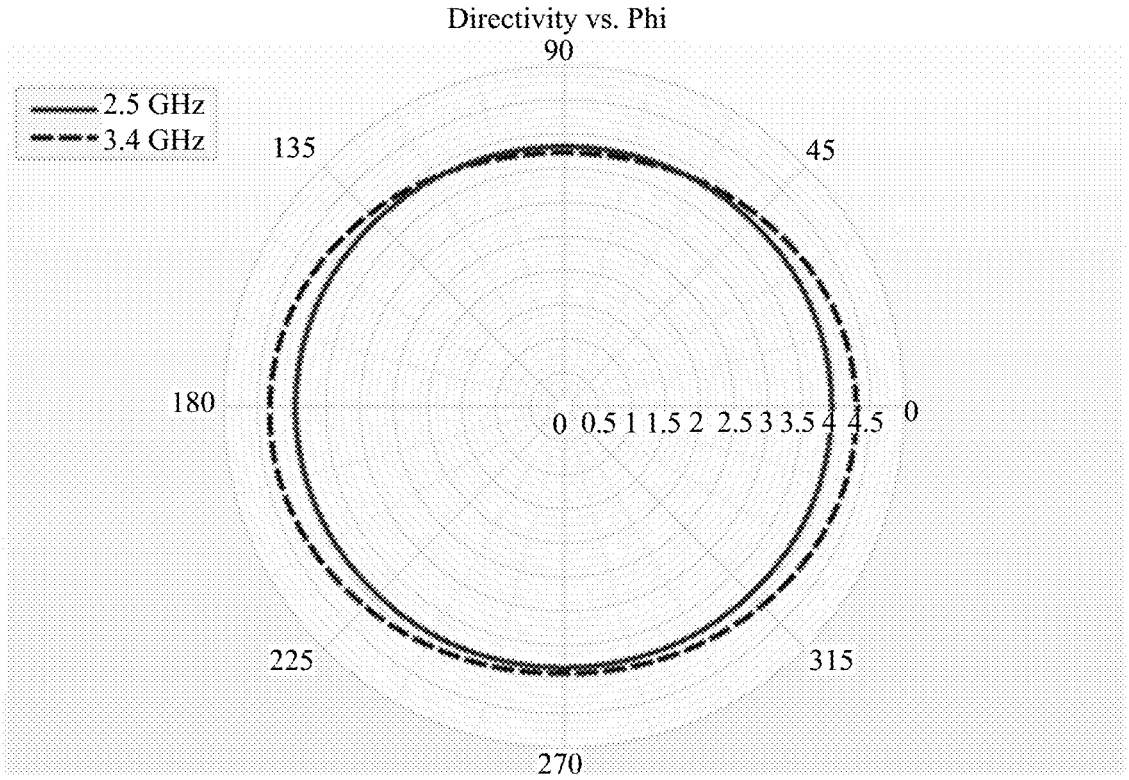
FIG. 19 is another diagram of a radiation pattern of an antenna according to an embodiment of this application.

For radiation patterns of the antenna with a slot in the Band41 and the Band42 in a horizontal direction in an embodiment of this application, refer to FIG. 19. It can be learnt from FIG. 19 that the antenna provided in this embodiment of this application can implement omnidirectional radiation in a horizontal direction in the Band41 and the Band42. In this embodiment of this application, one antenna is used to implement dual-band radiation, that is, in the Band41 and the Band42. The antenna can be applied to various network devices, including network devices such as CPE, a router, and a mobile phone, so that the network device can horizontally transmit or receive signals in a plurality of frequency bands omnidirectionally when using only one antenna.

Figure 20A:
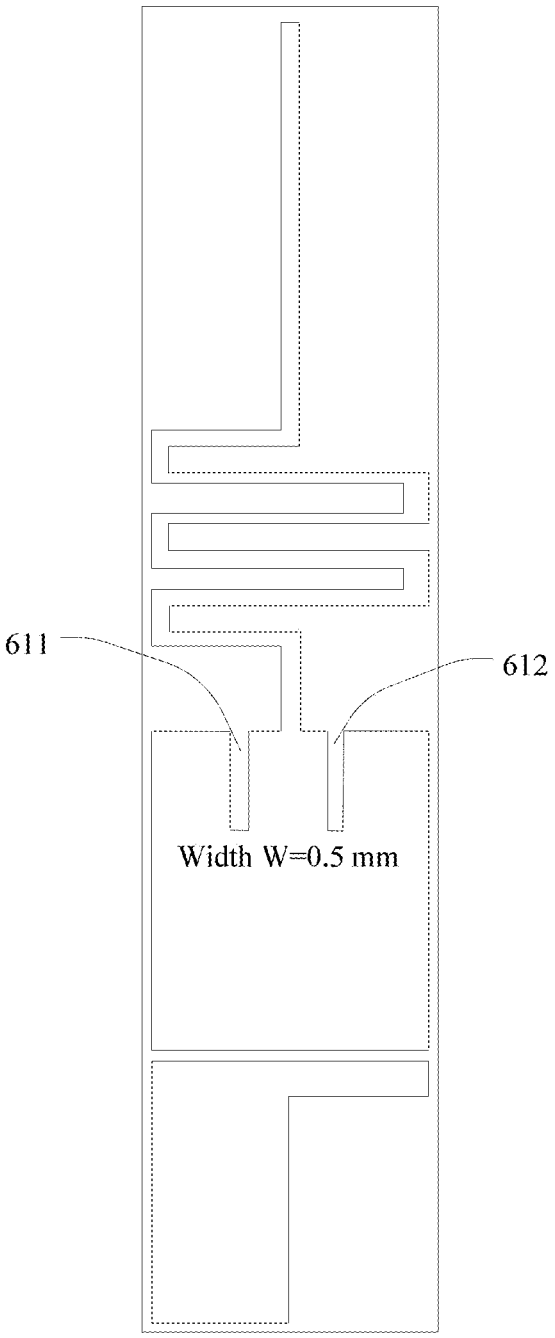
FIG. 20A is a schematic diagram of another embodiment of an antenna according to an embodiment of this application.
Figure 20B:
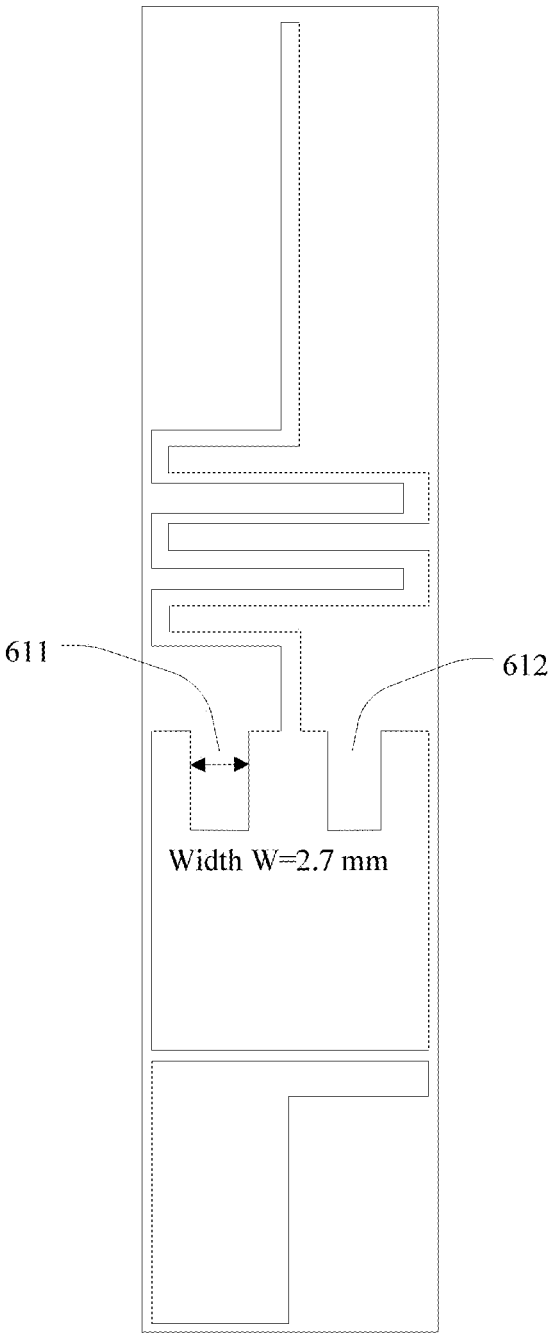
FIG. 20B is a schematic diagram of another embodiment of an antenna according to an embodiment of this application.
Figure 20C:
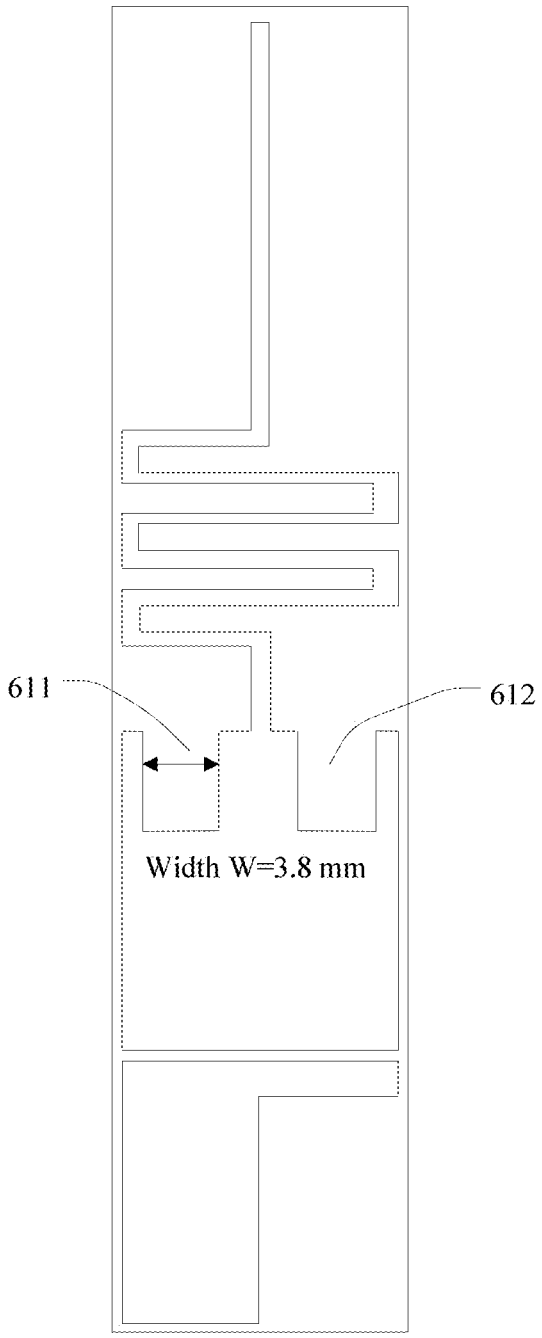
FIG. 20C is a schematic diagram of another embodiment of an antenna according to an embodiment of this application.

The foregoing details the antenna with a slot and the antenna without a slot in this embodiment of this application through comparison. In addition, slot widths of antennas with slots are further compared in this application. The following specifically describes antennas of different slot widths in this embodiment of this application. Referring to FIG. 20A, FIG. 20B, and FIG. 20C, FIG. 20A is a schematic diagram of an embodiment of an antenna that has a slot 611 and a slot 612 whose widths are 0.5 mm in this application, FIG. 20B is a schematic diagram of an embodiment of an antenna that has a slot 611 and a slot 612 whose widths are 2.7 mm in an embodiment of this application, and FIG. 20C is a schematic diagram of an embodiment of an antenna that has a slot 611 and a slot 612 whose widths are 3.8 mm in an embodiment of this application. It should be noted that for the antennas in FIG. 20A, FIG. 20B, and FIG. 20C in this embodiment of this application, except for different slot widths, lengths of other parts such as a top radiating element 301 and a top radiating element 303 are similar to those of other parts such as a top radiating element 301 and a top radiating element 303 in FIG. 2 to FIG. 7. Details are not described herein again.

Figure 21A:
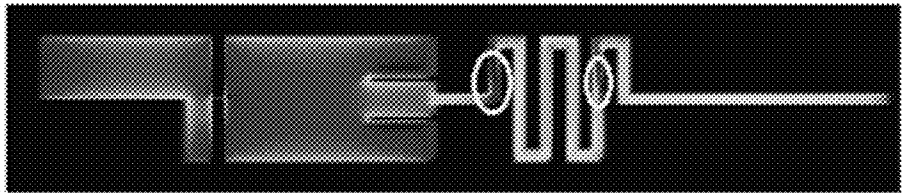
FIG. 21A is another current distribution diagram of an antenna according to an embodiment of this application.
Figure 21B:
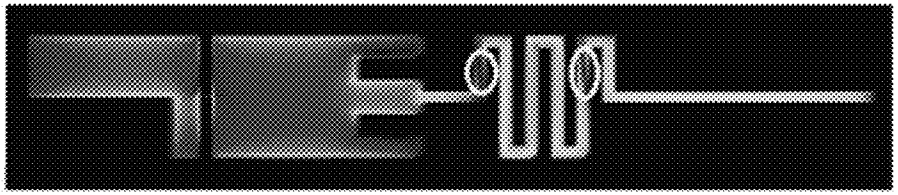
FIG. 21B is another current distribution diagram of an antenna according to an embodiment of this application.
Figure 21C:
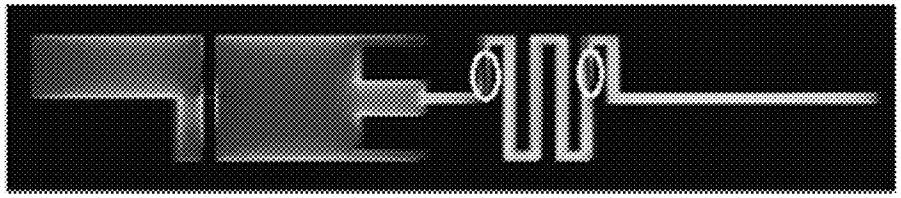
FIG. 21C is another current distribution diagram of an antenna according to an embodiment of this application.
Figure 22A:
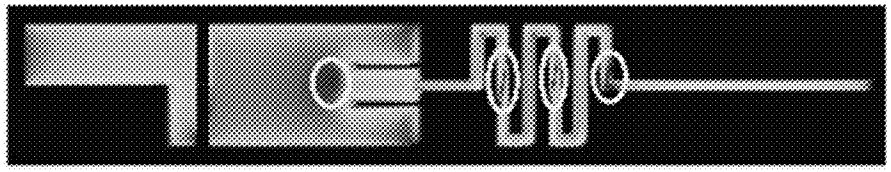
FIG. 22A is another current distribution diagram of an antenna according to an embodiment of this application.
Figure 22B:
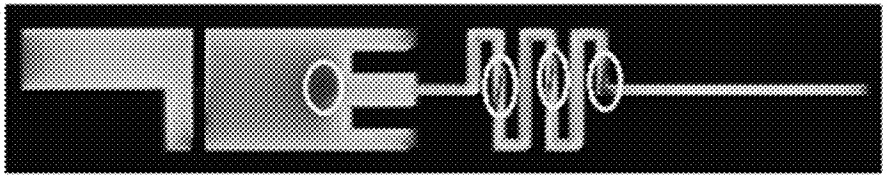
FIG. 22B is another current distribution diagram of an antenna according to an embodiment of this application.
Figure 22C:
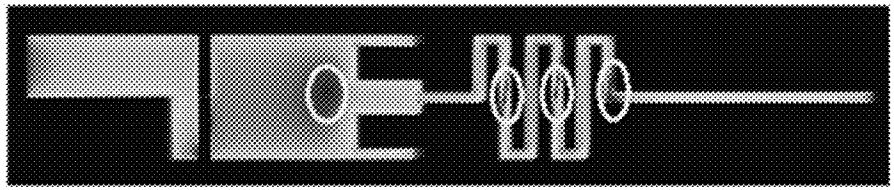
FIG. 22C is another current distribution diagram of an antenna according to an embodiment of this application.

FIG. 21A, FIG. 21B, and FIG. 21C are respectively current distribution diagrams of antennas with slot widths 0.5 mm, 2.7 mm, and 3.8 mm in a frequency band whose center frequency is 2.6 GHz. It can be learnt through simulation that current distribution of the antennas with the widths 0.5 mm, 2.7 mm, and 3.8 mm in the frequency band whose center frequency is 2.6 GHz are similar. FIG. 22A, FIG. 22B, and FIG. 22C are respectively current distribution diagrams of antennas with slot widths 0.5 mm, 2.7 mm, and 3.8 mm in a frequency band whose center frequency is 3.5 GHz. It can be learnt through simulation that current distribution of the antennas with the widths 0.5 mm, 2.7 mm, and 3.8 mm in the frequency band whose center frequency is 3.5 GHz are similar.

Figure 23:
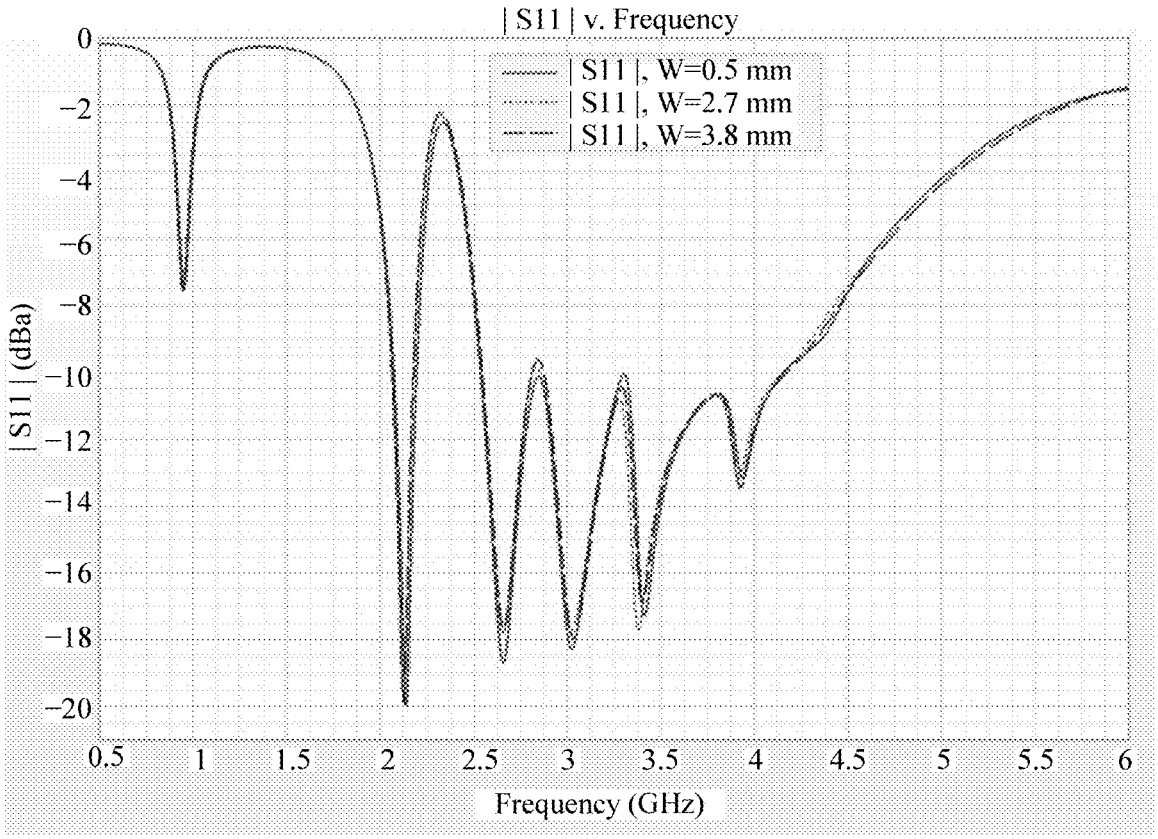
FIG. 23 is another schematic diagram of a return loss of an antenna according to an embodiment of this application.

FIG. 23 is a diagram of return losses of an antenna of different slot widths according to an embodiment of this application. It can be learnt from FIG. 23 that the return losses of the antenna of the different slot widths in frequency bands are similar in this embodiment of this application. In other words, slot widths impose slight impact on horizontal directions of the antenna in the frequency bands. Moreover, widths of a microstrip 613 and a microstrip 65 on outer sides of a slot cannot be excessively narrow, so as to avoid losing an effect of offsetting a phase inversion current at a microstrip 614 due to the excessively narrow microstrip 613 and microstrip 65 on the outer sides of the slot. For example, minimum widths of the microstrip 613 and the microstrip 65 may be 2 mm, so that the phase inversion current at the microstrip portion 614 can be offset.

Figure 24A:
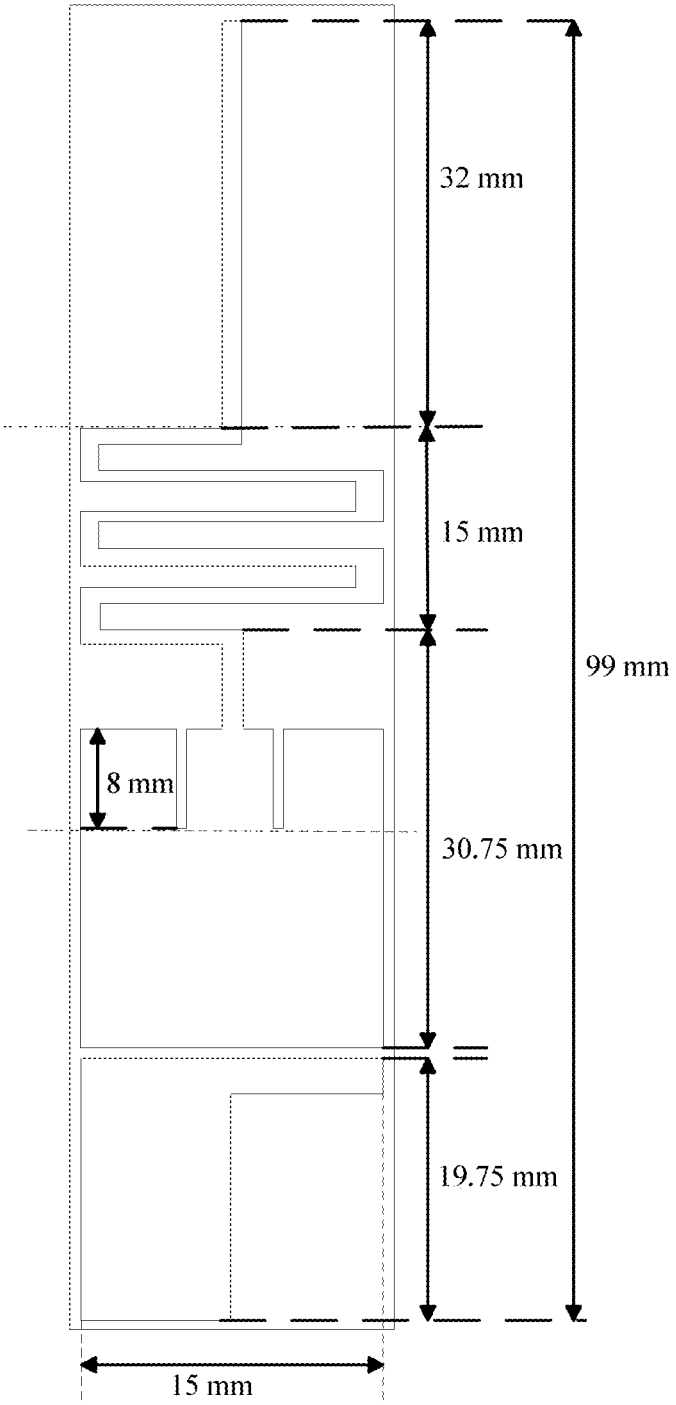
FIG. 24A is a schematic diagram of another embodiment of an antenna according to an embodiment of this application.
Figure 24B:
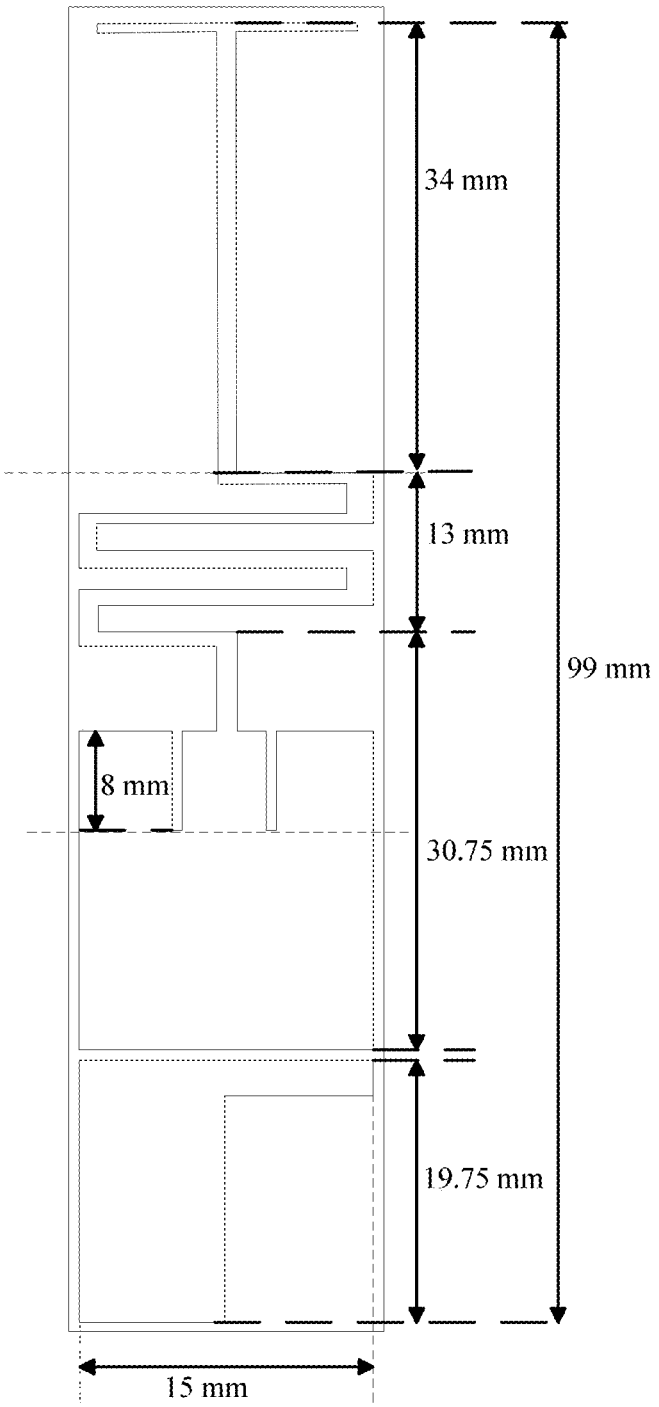
FIG. 24B is a schematic diagram of another embodiment of an antenna according to an embodiment of this application.
Figure 25A:
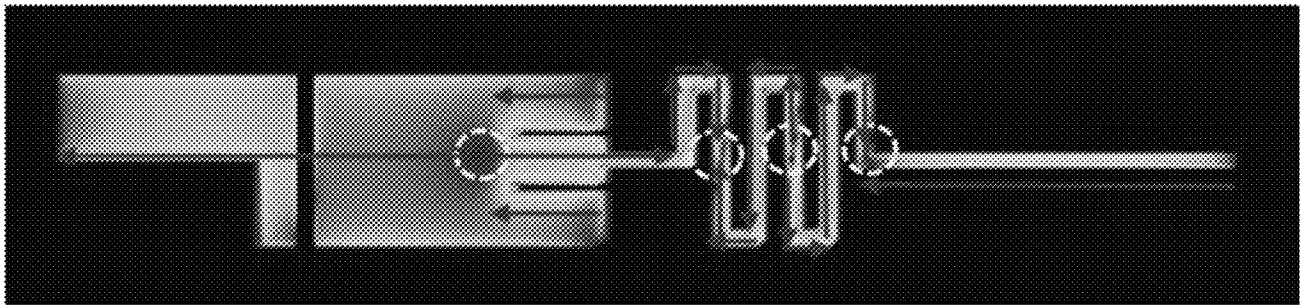
FIG. 25A is another current distribution diagram of an antenna according to an embodiment of this application.
Figure 25B:
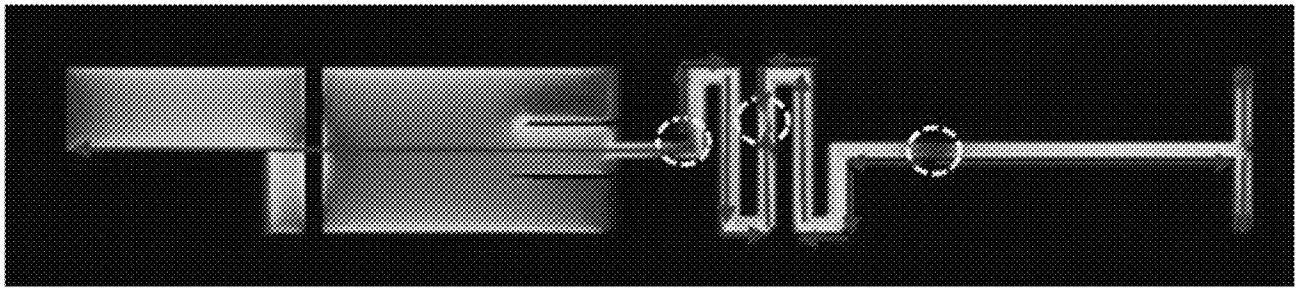
FIG. 25B is another current distribution diagram of an antenna according to an embodiment of this application.
Figure 26:
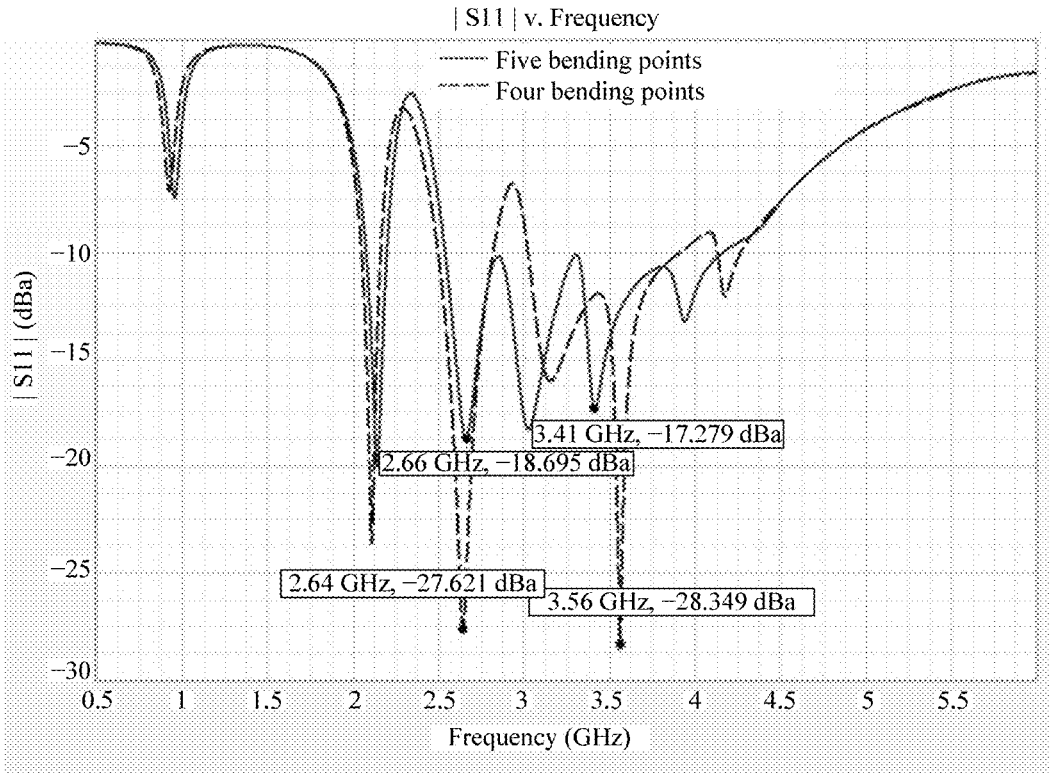
FIG. 26 is another schematic diagram of a return loss of an antenna according to an embodiment of this application.
Figure 27:
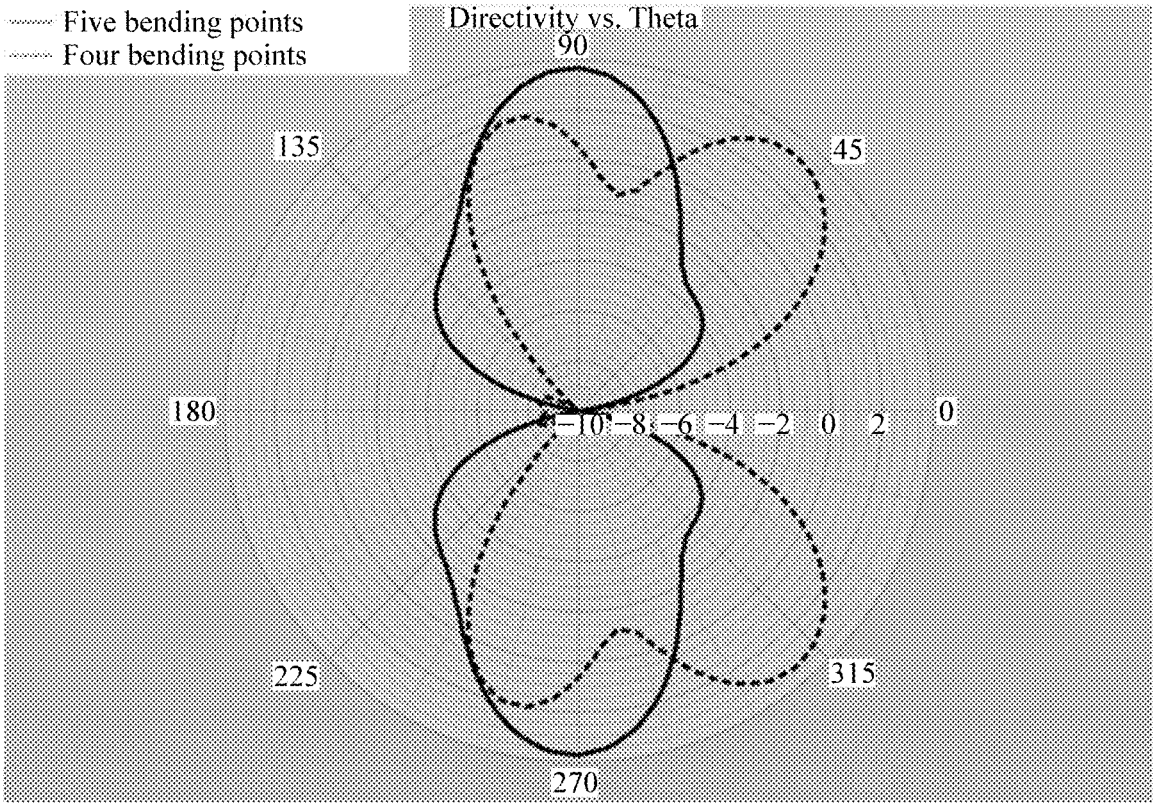
FIG. 27 is another diagram of a radiation pattern of an antenna according to an embodiment of this application.

The foregoing describes impact of the slot widths of the antenna on an operating frequency band. In addition, lengths of radiating elements and a phase inversion unit of the antenna also have impact on the operating frequency band of the antenna. For example, a quantity of bending points in a fold part of the phase inversion unit has impact on the operating frequency band of the antenna. In an embodiment of this application, an antenna 1 with five bending points is shown in FIG. 24A, and an antenna 2 with four bending points is shown in FIG. 24B. A fold part of a phase inversion unit of the antenna 1 includes the five bending points in FIG. 24A, and the antenna 2 has the four bending points in FIG. 24B. Total lengths of the antenna 1 and the antenna 2 are the same. A length of a top radiating element of the antenna 1 is 32 mm, a length of a top radiating element of the antenna 2 is 34 mm, lengths of bottom radiating elements of the antenna 1 and the antenna 2 are the same, lengths of slot portions of the phase inversion units of the antenna 1 and the antenna 2 are both 8 mm, and widths of the antenna 1 and the antenna 2 are both 15 mm. A current distribution diagram of the antenna 1 in a frequency band whose center frequency is 3.5 GHz is shown in FIG. 25A, and a current distribution diagram of the antenna 2 in a frequency band whose center frequency is 3.5 GHz is shown in FIG. 25B. With reference to FIG. 26 that shows a schematic diagram of return losses of the antenna 1 and the antenna 2 according to an embodiment of this application and FIG. 23A and FIG. 23B that show the current distribution diagrams of the antenna 1 and the antenna 2 in the frequency band whose center frequency is 3.5 GHz, it can be learnt that the antenna 2 has only three phase inversion points. In this case, when the antenna 2 operates the frequency band whose center frequency is 3.5 GHz, a length of the antenna is four half-wavelengths corresponding to the frequency band. As a result, a main beam in a frequency band Band42 is not on a horizontal plane, and a ratio of resonances of the antenna 1 at 2.6 GHz and 3.5 GHz is lower. A schematic diagram illustrating that the antenna 1 and the antenna 2 are in a frequency band whose center frequency is 3.5 GHz in a vertical direction is shown in FIG. 27. It can be learnt from FIG. 27 that the antenna 1 performs radiation in a horizontal direction and a main beam of the antenna 2 is not on a horizontal plane. Therefore, compared with the antenna whose phase inversion unit has four bending points, the antenna whose phase inversion unit has five bending points is closer to a horizontal direction during radiation in the frequency band Band42.

Figure 28A:
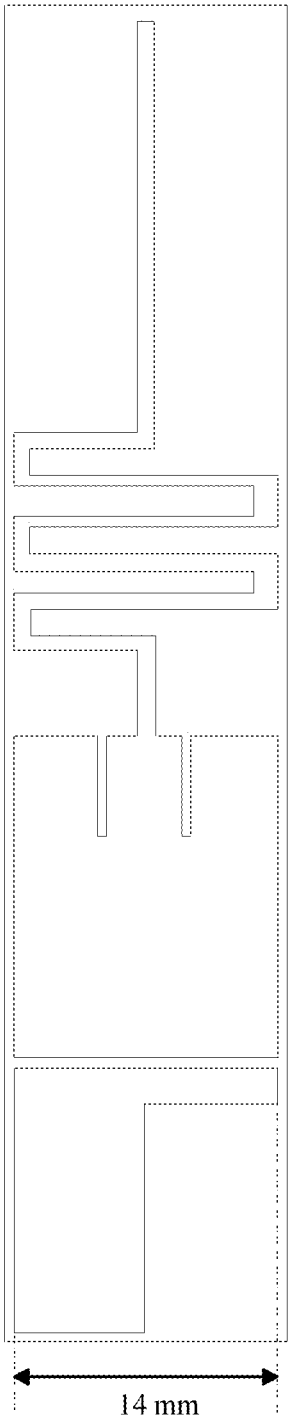
FIG. 28A is a schematic diagram of another embodiment of an antenna according to an embodiment of this application.
Figure 28B:
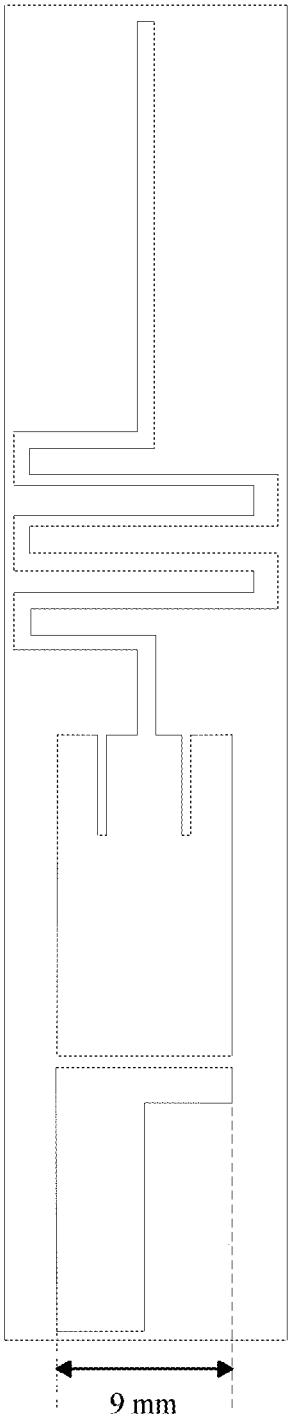
FIG. 28B is a schematic diagram of another embodiment of an antenna according to an embodiment of this application.
Figure 29:
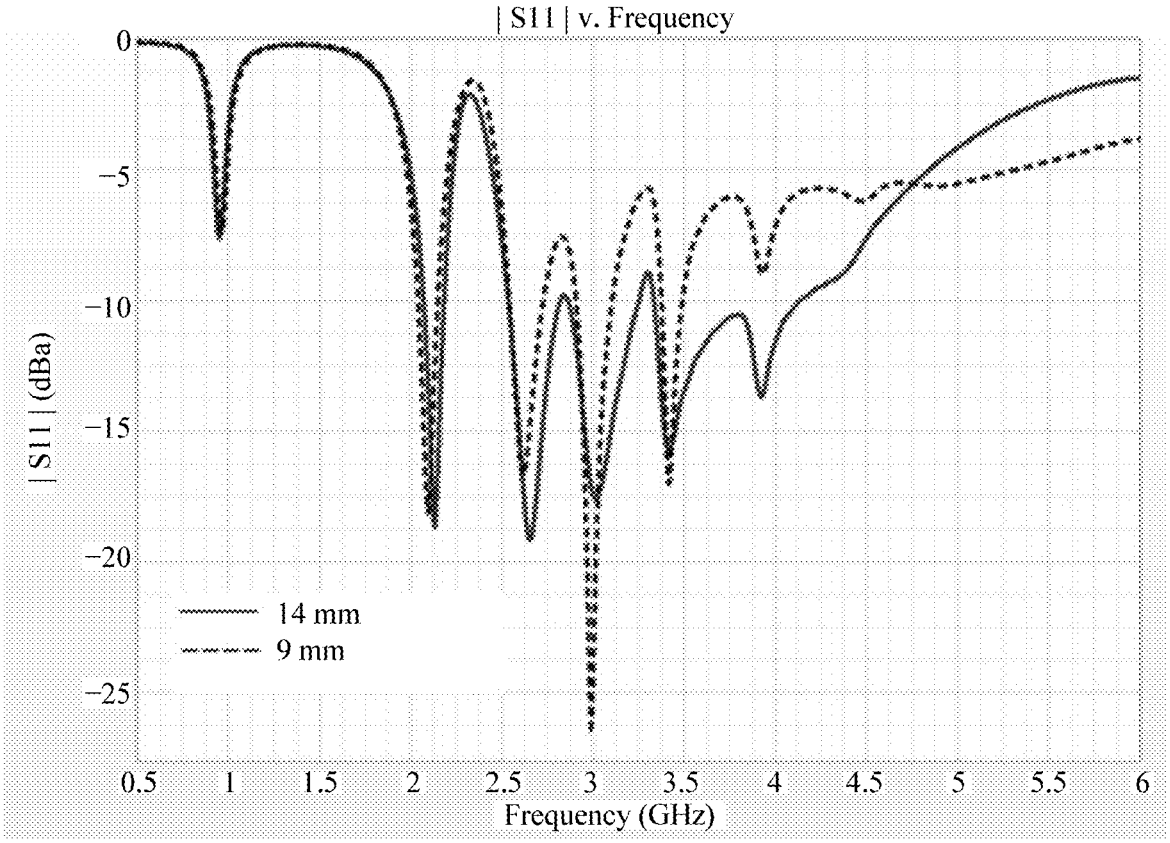
FIG. 29 is another schematic diagram of a return loss of an antenna according to an embodiment of this application.

In addition, a width of a bottom radiating element of an antenna in this embodiment of this application also has impact on bandwidth of the antenna. Referring to FIG. 28A and FIG. 28B, FIG. 28A shows an antenna whose bottom radiating element is 14 mm in width, and FIG. 28B shows an antenna whose bottom radiating element is 9 mm in width. Return losses of the antennas whose bottom radiating elements are 14 mm and 9 mm in width are shown in FIG. 29. It can be learnt from FIG. 28A, FIG. 28B, and FIG. 29 that bandwidth of the antenna whose bottom radiating element is 14 mm in width is obviously greater than that of the antenna whose bottom radiating element is 9 mm in width. Therefore, a greater width of a bottom radiating element of an antenna in this embodiment of this application indicates higher bandwidth corresponding to a frequency band covered by the antenna. In actual design, a width of a bottom radiating element can be adjusted depending on an actual design requirement. For example, the width of the bottom radiating element can be designed based on a total width of an antenna, where the width of the bottom radiating element does not exceed the total width of the antenna; or the width of the bottom radiating element can be designed based on required bandwidth, so that a frequency range of an antenna covers a required frequency band. This is not specifically limited herein.

Figure 30:
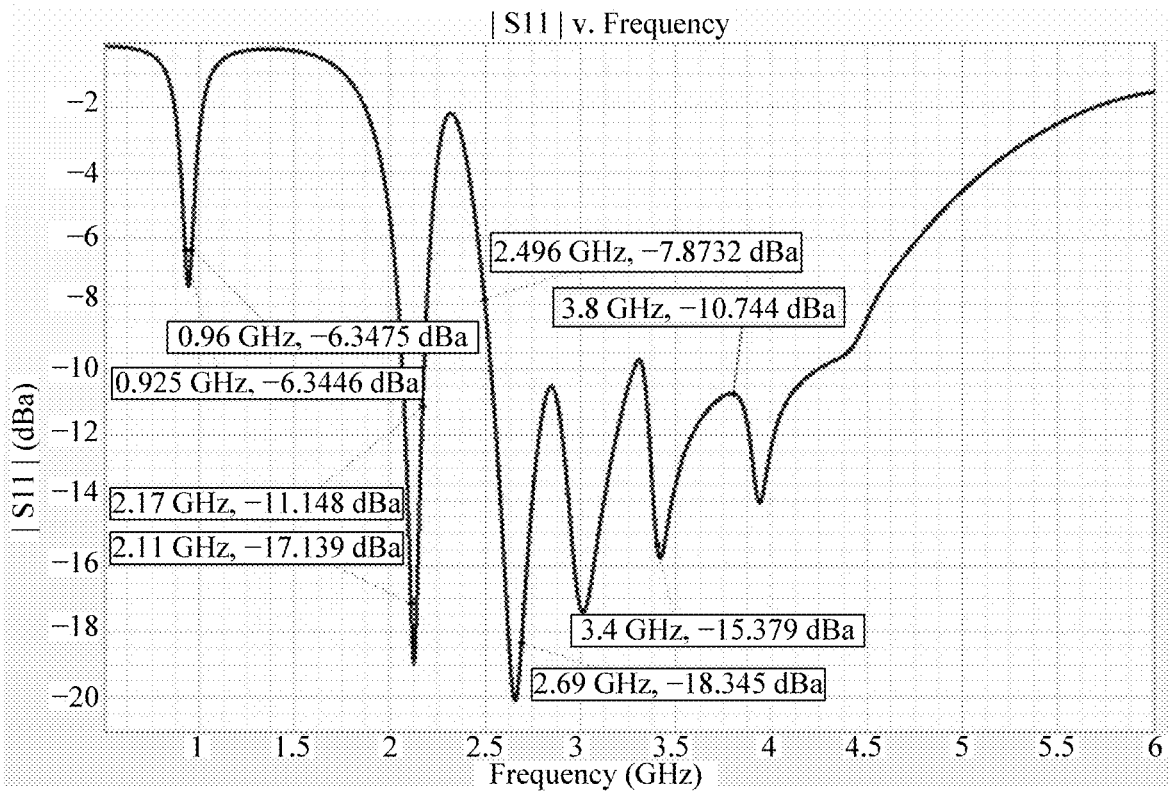
FIG. 30 is another schematic diagram of a return loss of an antenna according to an embodiment of this application.

The foregoing details the antennas in this embodiment of this application through comparison. A return loss of an antenna provided in an embodiment of this application is shown in FIG. 30. It can be learnt from FIG. 30 that the antenna generates six resonances whose resonance frequencies are 0.94 GHz, 2.12 GHz, 2.65 GHz, 3.0 GHz, 3.42 GHz, and 3.94 GHz, and current modes are modes corresponding to one half-wavelength, two half-wavelengths, three half-wavelengths, four half-wavelengths, five half-wavelengths, and six half-wavelengths. It should be understood that a half-wavelength corresponding to each resonance frequency is half of a wavelength corresponding to the resonance frequency. The half-wavelength mode is a mode corresponding to a low frequency band whose center frequency is 0.94 GHz, and a receive frequency band (925 MHz to 960 MHz) of an LTE Band8 (880 MHz to 960 MHz) can be covered in such a mode. If a matched capacitor or inductor is connected to the antenna, Band8 signal radiation can also be implemented. Specifically, adjustment can be made depending on an actual design requirement. The two half-wavelengths are corresponding to an operating mode in a frequency band whose center frequency is 2.12 GHz, and a receive frequency band (2110 MHz to 2170 MHz) of an LTE Band1 (1920 MHz to 2170 MHz) can be covered in such a mode. If a matched capacitor or inductor is connected to the antenna, Band1 signal radiation can also be implemented. Specifically, adjustment can be made depending on an actual design requirement. In an operating mode corresponding to the three half-wavelengths, a frequency band Band41 is completely covered, and there is a feature of horizontal high-gain omnidirection. Bandwidth corresponding to the five half-wavelengths is relatively high with coverage of 3.4 GHz to 3.8 GHz, may be corresponding to a Band42 and a Band43 in an LTE system, and has a feature of horizontal high-gain omnidirection. Therefore, for the antenna provided in this embodiment of this application, one antenna body can radiate or receive signals in a plurality of LTE frequency bands, and can be applied to various network devices, so that the network device uses one antenna to radiate and receive the signals in the plurality of frequency bands. This can reduce a size of the network device, and reduce costs of the network device.

In addition, in actual design, if the antenna provided in this embodiment of this application is used in CPE, an antenna design with separation of low and high frequencies is used for the CPE product. An operating frequency band corresponding to the two half-wavelengths for a high-frequency antenna, namely, the antenna provided in this embodiment of this application, covers a low frequency of 1 GHz, and consequently efficiency of an LTE low-frequency antenna may be decreased. In this case, a high-pass filter circuit may be added to a feed path of the high-frequency antenna, to filter out a low-frequency signal, thereby reducing impact on the LTE low-frequency antenna.

Moreover, the antenna provided in this embodiment of this application may be an end-fed antenna or a center-fed antenna. When the antenna is a center-fed antenna, an upper part of the antenna is similar to that of an end-fed antenna, and a lower part and the upper part are symmetrical in shape. A specific operating principle of the center-fed antenna is similar to that of the end-fed antenna. Details are not described herein.

The foregoing details the antenna provided in this embodiment of this application. In addition, the antenna provided in this embodiment can further be applied to a network device such as CPE, a router, or a terminal device. The following describes a device provided in an embodiment of this application. FIG. 30 is a schematic diagram of an embodiment of CPE according to an embodiment of this application.

Figure 31:
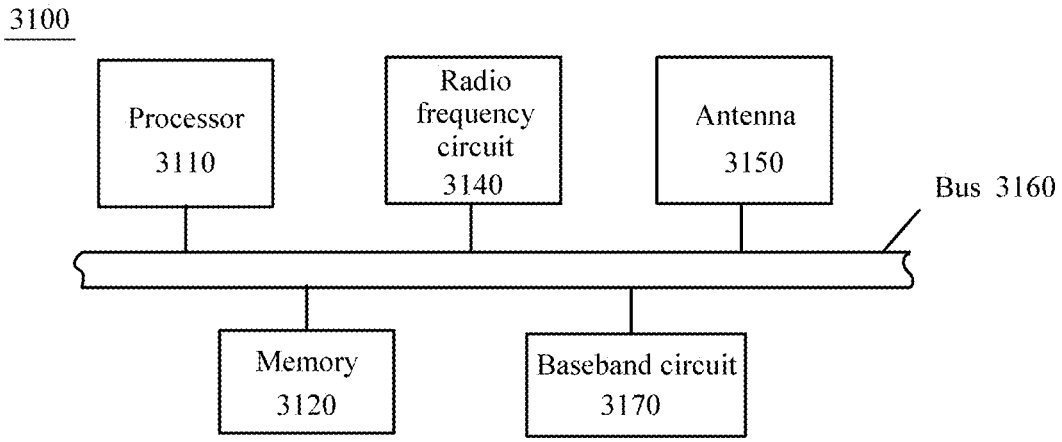
FIG. 31 is a schematic diagram of an embodiment of customer premises equipment CPE according to an embodiment of this application.

FIG. 31 is a schematic structural diagram of a hardware apparatus of CPE according to this application. The CPE 3100 includes a processor 3110, a memory 3120, a baseband circuit 3130, a radio frequency circuit 3140, an antenna 3150, and a bus 3160. The processor 3110, the memory 3120, the baseband circuit 3130, the radio frequency circuit 3140, and the antenna 3150 are connected through the bus 3160. The memory 3120 stores corresponding operation instructions. The processor 3110 executes the operation instructions to control the radio frequency circuit 3140, the baseband circuit 3130, and the antenna 3150 to operate, so as to perform corresponding operations. For example, the processor 3110 may control the radio frequency circuit to generate a combined signal, and then radiate a first signal in a first frequency band and a second signal in a second frequency band by using the antenna.

Figure 32:
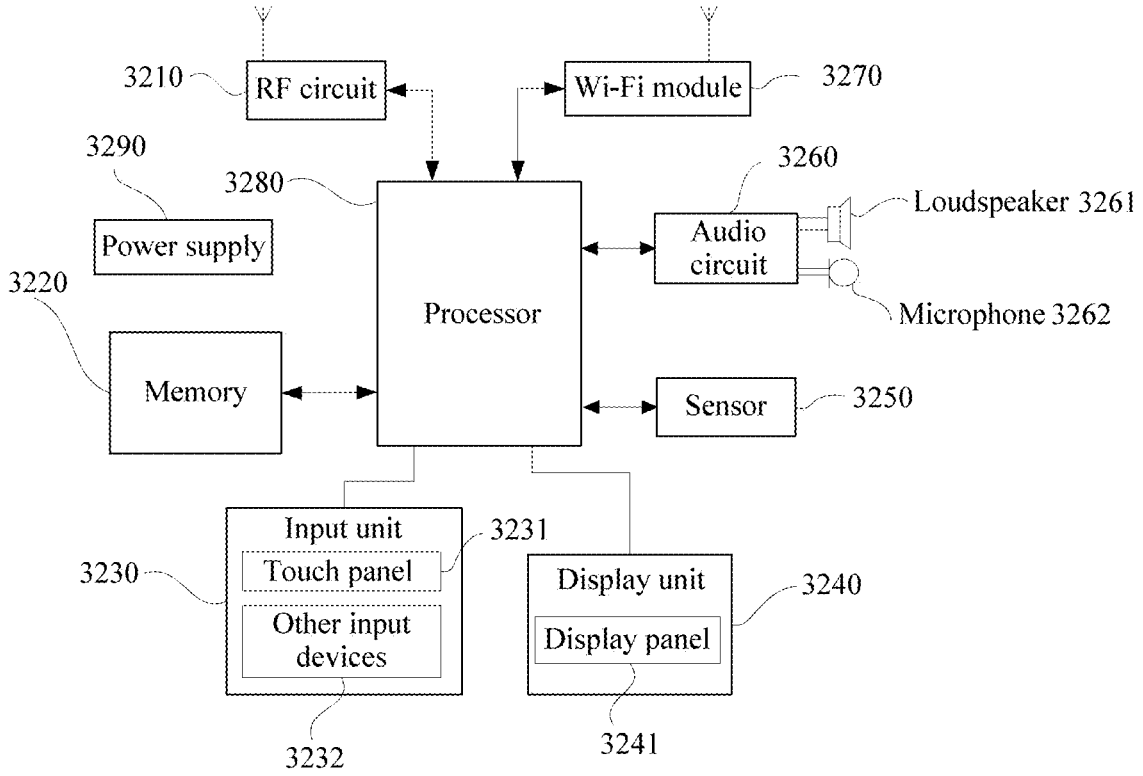
FIG. 32 is a schematic diagram of an embodiment of a terminal device according to an embodiment of this application.

In addition to the CPE, an embodiment of this application further provides a terminal device, as shown in FIG. 32. For ease of description, only a part related to this embodiment of the present application is shown. For specific technical details not disclosed, refer to the method embodiment of the present invention. The terminal may be any terminal device including a mobile phone, a tablet computer, a PDA (Personal Digital Assistant, personal digital assistant), a POS (Point of Sales, point of sale), a vehicle-mounted computer, or the like. For example, the terminal is a mobile phone.

FIG. 32 is a block diagram of a partial structure of a mobile phone related to a terminal according to an embodiment of the present invention. Referring to FIG. 32, the mobile phone includes components such as a radio frequency (Radio Frequency, RF) circuit 3210, a memory 3220, an input unit 3230, a display unit 3240, a sensor 3250, an audio circuit 3260, a wireless fidelity (wireless fidelity, WiFi) module 3270, a processor 3280, and a power supply 3290. Persons skilled in the art can understand that the structure of the mobile phone shown in FIG. 32 does not constitute any limitation on the mobile phone, and may include more or fewer components than those shown in the figure, a combination of some components, or components differently disposed.

The following specifically describes the constituent parts of the mobile phone with reference to FIG. 32.

The RF circuit 3210 may be configured to receive and send signals in an information receiving/sending process or a call process. Particularly, the RF circuit 3210 receives downlink information of a base station and sends the downlink information to the processor 3280 for processing; and sends uplink data to the base station. Generally, the RF circuit 3210 includes but is not limited to an antenna, at least one amplifier, a transceiver, a coupler, a low noise amplifier (Low Noise Amplifier, LNA), and a duplexer. The antenna can radiate signals in at least two frequency bands. For example, the antenna can radiate signals in all frequency bands Band41, Band42, and Band43 in an LTE system. In addition, the RF circuit 3210 may also communicate with a network and other devices through wireless communication. For the wireless communication, any communication standard or protocol may be used, including but not limited to global system for mobile communications (Global System of Mobile communication, GSM), general packet radio service (General Packet Radio Service, GPRS), code division multiple access (Code Division Multiple Access, CDMA), wideband code division multiple access (Wideband Code Division Multiple Access, WCDMA), long term evolution (Long Term Evolution, LTE), email, and short message service (Short Messaging Service, SMS).

The memory 3220 may be configured to store a software program and a module. The processor 3280 performs various function applications and data processing of the mobile phone by running the software program and the module that are stored in the memory 3220. The memory 3220 may mainly include a program storage area and a data storage area. The program storage area may store an operating system, an application program required by at least one function (such as a voice playback function and an image display function), and the like. The data storage area may store data (such as audio data and a phone book) created based on use of the mobile phone, and the like. In addition, the memory 3220 may include a high-speed random access memory, and may further include a non-volatile memory such as at least one magnetic disk storage device, a flash memory device, or another volatile solid-state storage device.

The input unit 3230 may be configured to receive input digital or character information and generate key signal input related to user setting and function control of the mobile phone. Specifically, the input unit 3230 may include a touch panel 3231 and other input devices 3232. The touch panel 3231, also referred to as a touchscreen, may collect a touch operation performed by a user on or near the touch panel 3231 (for example, an operation performed by the user on the touch panel 3231 or near the touch panel 3231 by using any appropriate object or accessory, such as a finger or a stylus), and drive a corresponding connection apparatus according to a preset program. Optionally, the touch panel 3231 may include two parts: a touch detection apparatus and a touch controller. The touch detection apparatus detects a touch location of the user, detects a signal generated by a touch operation, and transmits the signal to the touch controller. The touch controller receives touch information from the touch detection apparatus, converts the touch information into contact coordinates, and sends the contact coordinates to the processor 3280, and is also capable of receiving and executing a command sent by the processor 3280. In addition, the touch panel 3231 may be implemented by using a plurality of types, such as a resistive type, a capacitive type, an infrared type, and a surface acoustic wave type. In addition to the touch panel 3231, the input unit 3230 may further include the other input devices 3232. Specifically, the other input devices 3232 may include but are not limited to one or more of a physical keyboard, a function key (such as a volume control key and an on/off key), a trackball, a mouse, and a joystick.

The display unit 3240 may be configured to display information entered by the user, information provided for the user, and various menus of the mobile phone. The display unit 3240 may include a display panel 3241. Optionally, the display panel 3241 may be configured in a form of a liquid crystal display (Liquid Crystal Display, LCD), an organic light-emitting diode (Organic Light-Emitting Diode, OLED), or the like. Further, the touch panel 3231 may cover the display panel 3241. After detecting a touch operation on or near the touch panel 3231, the touch panel 3241 transmits information about the touch operation to the processor 3280 to determine a touch event type, and then the processor 3280 provides corresponding visual output on the display panel 3241 based on the touch event type. In FIG. 32, the touch panel 3231 and the display panel 3241 are used as two independent components to implement input and output functions of the mobile phone. However, in some embodiments, the touch panel 3231 and the display panel 3241 may be integrated to implement the input and output functions of the mobile phone.

The mobile phone may further include at least one sensor 3250 such as a light sensor, a motion sensor, or another sensor. Specifically, the light sensor may include an ambient light sensor and a proximity sensor. The ambient light sensor may adjust luminance of the display panel 3241 based on brightness of ambient light. The proximity sensor may turn off the display panel 3241 and/or backlight when the mobile phone moves close to an ear. As a type of motion sensor, an accelerometer sensor may detect values of acceleration in various directions (usually, there are three axes), may detect, in a static state, a value and a direction of gravity, and may be used for applications that recognize postures (for example, screen switching between a landscape mode and a portrait mode, a related game, and magnetometer posture calibration) of the mobile phone, vibration-recognition-related functions (for example, a pedometer and tapping), and the like. Other sensors that can be configured on the mobile phone such as a gyroscope, a barometer, a hygrometer, a thermometer, and an infrared sensor are not described herein.

The audio circuit 3260, a loudspeaker 3261, and a microphone 3262 may provide an audio interface between the user and the mobile phone. The audio circuit 3260 may transmit, to the loudspeaker 3261, an electrical signal that is converted from received audio data, and the loudspeaker 3261 converts the electrical signal into a sound signal and outputs the sound signal. In addition, the microphone 3262 converts a collected sound signal into an electrical signal; the audio circuit 3260 receives the electrical signal and converts the electrical signal into audio data, and outputs the audio data to the processor 3280 for processing; and then processed audio data is sent to, for example, another mobile phone by using the RF circuit 3210, or the audio data is output to the memory 3220 for further processing.

Wi-Fi is a short-range wireless transmission technology. By using the Wi-Fi module 3270, the mobile phone may help the user send and receive an email, browse a web page, access streaming media, and the like. The Wi-Fi module 3270 provides wireless broadband Internet access for the user. Although FIG. 32 shows the Wi-Fi module 3270, it can be understood that the Wi-Fi module 3270 is not a mandatory constituent of the mobile phone, and may be totally omitted depending on requirements without changing the essence cope of the present invention.

The processor 3280 is a control center of the mobile phone, is connected to all the parts of the entire mobile phone by using various interfaces and lines, and performs various functions and data processing of the mobile phone by running or executing the software program and/or the module that are/is stored in the memory 3220 and by invoking data stored in the memory 3220, so as to perform overall monitoring on the mobile phone. Optionally, the processor 3280 may include one or more processing units. Preferably, an application processor and a modem processor may be integrated into the processor 3280. The application processor mainly processes an operating system, a user interface, an application program, and the like, and the modem processor mainly processes wireless communication. It can be understood that the modem processor may alternatively not be integrated into the processor 3280.

The mobile phone further includes the power supply 3290 (for example, a battery) that supplies power to all the components. Preferably, the power supply may be logically connected to the processor 3280 by using a power management system, so that functions such as charging and discharging management and power consumption management are implemented by using the power management system.

Although not shown, the mobile phone may further include a camera, a Bluetooth module, and the like. Details are not described herein.

In conclusion, the foregoing embodiments are merely intended to describe the technical solutions of this application, but not to limit this application. Although this application is described in detail with reference to the foregoing embodiments, persons of ordinary skill in the art should understand that they may still make modifications to the technical solutions described in the foregoing embodiments or make equivalent replacements to some technical features thereof, without departing from the scope of the technical solutions of the embodiments of this application.

What is claimed is:

1. An antenna, comprising:

a medium substrate;

a top radiating element;

a phase inverter; and a bottom radiating element; and wherein the antenna is configured to radiate a signal in a Band41 and a signal in a Band42, a wavelength corresponding to a center frequency of the signal in the Band41 is $\lambda_1$, and a wavelength corresponding to a center frequency of the signal in the Band42 is $\lambda_2$;

wherein the medium substrate is a carrier of the top radiating element, the phase inverter, and the bottom radiating element;

wherein an end of the top radiating element is connected to an end of the phase inverter;

wherein another end of the phase inverter is connected to an end of the bottom radiating element, a length of the phase inverter is $3\lambda_2/2$, and the length of the phase inverter is greater than $\lambda_1/2$; and wherein the phase inverter comprises at least two current phase inversion points, a part between two of the at least two current phase inversion points is configured to produce no radiation, and the top radiating element and the bottom radiating element are configured to horizontally radiate the signal in the Band41 and the signal in the Band42 omnidirectionally.

2. An antenna, comprising:

a medium substrate;

a top radiating element;

a phase inverter; and a bottom radiating element;

wherein the antenna is configured to radiate a first signal and a second signal, the first signal and the second signal are in different frequency bands, a first half-wavelength is half of a wavelength corresponding to the first signal, and a second half-wavelength is half of a wavelength corresponding to the second signal;

wherein the medium substrate is a carrier of the top radiating element, the phase inverter, and the bottom radiating element;

wherein an end of the top radiating element is connected to an end of the phase inverter;

wherein another end of the phase inverter is connected to an end of the bottom radiating element, a length of the phase inverter is a first odd multiple of the second half-wavelength, and the length of the phase inverter is greater than a second odd multiple of the first half-wavelength; and wherein the phase inverter comprises at least two current phase inversion points, a part between two of the at least two current phase inversion points is configured to not produce radiation, and the top radiating element and the bottom radiating element are configured to horizontally radiate the first signal and the second signal omnidirectionally.

3. The antenna according to claim 2, wherein the phase inverter comprises:

a fold line part; and a vertical part, wherein the vertical part comprises a first slot and a second slot, the first slot is parallel to the second slot, and the first slot and the second slot divide the vertical part into a first microstrip, a second microstrip, and a third microstrip;

wherein the first microstrip and the third microstrip are respectively located on two sides of the second microstrip; and wherein the first microstrip, the second microstrip, and the third microstrip are configured in a manner that, when the antenna radiates the second signal, currents at the first microstrip and the second microstrip are in opposite directions, currents at the second microstrip and the third microstrip are in opposite directions, and the second microstrip produces no radiation.

4. The antenna according to claim 3, wherein a minimum width of the first microstrip is 2 mm.

5. The antenna according to claim 3, wherein a minimum width of the third microstrip is 2 mm.

6. The antenna according to claim 3, wherein a width of the first slot ranges from 0.5 mm to 3.8 mm.

7. The antenna according to claim 3, wherein a width of the second slot ranges from 0.5 mm to 3.8 mm.

8. The antenna according to claim 3, wherein a length of the first slot is 8 mm.

9. The antenna according to claim 3, wherein a length of the second slot is 8 mm.

10. The antenna according to claim 2, wherein a ratio between a frequency of the second signal and a frequency of the first signal ranges from 1.3 to 1.6.

11. The antenna according to claim 2, wherein the first signal is in a frequency band of 2496 MHz to 2690 MHz, and the second signal is in a frequency band of 3400 MHz to 3800 MHz.

12. The antenna according to claim 2, wherein a length of the antenna is three times the length of the first half-wavelength and five times the length of the second half-wavelength.

13. The antenna according to claim 12, wherein the length of the antenna is 99 mm.

14. The antenna according to claim 2, wherein the bottom radiating element comprises:

an upper radiating module; and a lower radiating module, wherein the upper radiating module is connected to the lower radiating module through a coaxial line, the lower radiating module comprises a gap portion, the coaxial line is located in the gap portion of the lower radiating module, and the coaxial line is configured to feed power to the antenna.

15. A terminal device, comprising:

a processor;

a non-transitory memory;

an input/output interface; and an antenna, comprising:

a medium substrate;

a top radiating element;

a phase inverter; and a bottom radiating element;

wherein the antenna is configured to radiate a first signal and a second signal, the first signal and the second signal are in different frequency bands, a first half-wavelength is half of a wavelength corresponding to the first signal, and a second half-wavelength is half of a wavelength corresponding to the second signal;

wherein the medium substrate is a carrier of the top radiating element, the phase inverter, and the bottom radiating element;

wherein an end of the top radiating element is connected to an end of the phase inverter;

wherein another end of the phase inverter is connected to an end of the bottom radiating element, a length of the phase inverter is a first odd multiple of the second half-wavelength, and the length of the phase inverter is greater than a second odd multiple of the first half-wavelength; and wherein the phase inverter comprises at least two current phase inversion points, a part between two of the at least two current phase inversion points is configured to produce no radiation, and the top radiating element and the bottom radiating element are configured to horizontally radiate the first signal and the second signal omnidirectionally.

16. The terminal device according to claim 15, wherein the first signal is in Band41, and the second signal is in Band42.

17. The terminal device according to claim 15, wherein the phase inverter comprises:

a fold line part; and a vertical part, wherein the vertical part comprises a first slot and a second slot, the first slot is parallel to the second slot, and the first slot and the second slot divide the vertical part into a first microstrip, a second microstrip, and a third microstrip;

wherein the first microstrip and the third microstrip are respectively located on two sides of the second microstrip; and wherein the first microstrip, the second microstrip, and the third microstrip are configured in a manner that, when the antenna radiates the second signal, currents at the first microstrip and the second microstrip are in opposite directions, currents at the second microstrip and the third microstrip are in opposite directions, and the second microstrip produces no radiation.

18. The terminal device according to claim 15, wherein a length of the antenna is three times the length of the first half-wavelength and five times the length of the second half-wavelength.

19. The terminal device according to claim 15, wherein the bottom radiating element comprises an upper radiating module and a lower radiating module, the upper radiating module is connected to the lower radiating module through a coaxial line, the lower radiating module comprises a gap portion, the coaxial line is located in the gap portion of the lower radiating module, and the coaxial line is configured to feed power to the antenna.

20. The terminal device according to claim 15, wherein a ratio between frequencies of the second signal and the first signal ranges from 1.3 to 1.6.

* * * * *